US006908367B2

(12) United States Patent
Wada et al.

(10) Patent No.: US 6,908,367 B2
(45) Date of Patent: Jun. 21, 2005

(54) APPARATUS FOR PROCESSING A LENS

(75) Inventors: Toyoji Wada, Tokyo (JP); Takashi Daimaru, Tokyo (JP); Masahiro Jinbo, Tokyo (JP)

(73) Assignee: Hoya Corporation, Tokyo (JP)

( * ) Notice: Subject to any disclaimer, the term of this patent is extended or adjusted under 35 U.S.C. 154(b) by 101 days.

(21) Appl. No.: 10/406,584

(22) Filed: Apr. 4, 2003

(65) Prior Publication Data

US 2003/0220056 A1 Nov. 27, 2003

(30) Foreign Application Priority Data

Apr. 8, 2002 (JP) ..... 2002-105565

(51) Int. Cl.[7] ..... B24B 1/00

(52) U.S. Cl. ..... 451/43; 451/44; 451/69; 451/255; 451/256

(58) Field of Search ..... 451/42, 43, 44, 451/65, 69, 255, 256

(56) References Cited

U.S. PATENT DOCUMENTS

| | | | | |
|---|---|---|---|---|
| 5,053,971 A | * | 10/1991 | Wood et al. | 700/164 |
| 5,363,597 A | | 11/1994 | Gottschald et al. | |
| 5,626,511 A | * | 5/1997 | Kennedy et al. | 451/461 |
| 5,803,793 A | * | 9/1998 | Mizuno et al. | 451/5 |
| 6,751,522 B2 | * | 6/2004 | Okada et al. | 700/164 |
| 2002/0026262 A1 | | 2/2002 | Takahiro et al. | |

FOREIGN PATENT DOCUMENTS

| | | |
|---|---|---|
| EP | 1 238 733 A | 9/2002 |
| JP | 6047656 | 2/1994 |
| JP | 2001018154 | 1/2001 |
| JP | 2001087922 | 4/2001 |
| JP | 2001 150314 A | 6/2001 |

OTHER PUBLICATIONS

EPO Communication with Partial European Search Report, completed Aug. 2, 2004.

* cited by examiner

*Primary Examiner*—Eileen P. Morgan
(74) *Attorney, Agent, or Firm*—Griffin & Szipl, P.C.

(57) ABSTRACT

An apparatus for processing a lens comprising a rotating tool for chamfering used for chamfering a peripheral portion of a spectacle lens, the apparatus comprising: a holding shaft supporting the lens and a lens-holding unit that rotates the holding shaft and displaces the lens towards the finishing unit based on data describing a shape of a lens frame and a rotation angle of the holding shaft; and a means for positioning in an axial direction that displaces the lens in an axial direction of the holding shaft; wherein the rotating tool for chamfering includes a rotating tool having a hemispherical shape, wherein a chamfering angle, or a chamfering amount, is set in accordance with a displacement in the axial direction of the means for positioning in an axial direction and a displacement of the lens-holding unit.

8 Claims, 14 Drawing Sheets

APPARATUS FOR PROCESSING A LENS

FIELD OF THE INVENTION

The present invention relates to an apparatus for processing a lens, used for processing the peripheral portion of a lens, such as a spectacle lens, to provide a prescribed shape so that the lens can be fitted into a lens frame of a spectacle frame.

BACKGROUND OF THE INVENTION

In the art of making lenses, when a lens, such as a spectacle lens, is processed so that the lens may be fitted into a lens frame of a spectacle frame, the peripheral face of an uncut lens is ground by a grinder, or cut by a cutter. In this manner, peripheral portion of the uncut lens is formed into a prescribed shape in accordance with data corresponding to the shape of the lens frame of the spectacle frame.

Prior art examples of the known processing apparatus for this purpose include, as disclosed in Japanese Patent Application Laid-Open No. 2001-18154, apparatuses in which, after the peripheral portion of a lens is processed by the flat grinding or the beveled grinding using a rotating tool (a grinder), which is freely rotated to grind the peripheral portion of a lens. The prior art apparatuses also conduct chamfering and grooving as steps in the finishing of the peripheral portion of the lens by using a grinder for chamfering and a grinder for grooving, which are coaxially disposed.

In Japanese Patent Application Laid-Open No. 2001-87922, an apparatus for chamfering and grooving the peripheral portion of a lens using a single ball end mill is disclosed.

However, as shown in FIG. 15, since conventional apparatuses, such as those described above, are equipped with a grinder for chamfering the concave face of the lens and a grinder for chamfering the convex face of the lens, wherein these grinders are formed integrally with a grinder for grooving that is disposed between these two grinders for chamfering, it occasionally occurs that, as shown in the portion A of FIG. 15, the grinder for grooving protrudes radially beyond the outside of the periphery of both grinders for chamfering, and one of the grinders for chamfering protrudes laterally at a peripheral portion so as to contact the lens-holding shaft and interfere with lens processing. When this problematical arrangement takes place, in particular, such as in the case of a lens having a small diameter, chamfering cannot be properly conducted. In the example of the conventional apparatus of FIG. 15, when changing the chamfering angle, the desired chamfering angle is achieved by inclination of the shaft upon which the grinder for chamfering is mounted. This method for changing the chamfering angle is problematical in that, in order to conduct chamfering while the shaft is inclined at various desired angles, the apparatus required includes complicated driving mechanisms and supporting mechanisms for the tool, and the size of the apparatus increases.

In the example described in FIG. 15, the grooving is conducted by using the tip of a ball end mill and the chamfering is conducted by using a side face of the same single ball end mill. Since the outer diameter of the ball end mill is determined by the width of the groove formed at the outer peripheral face of the lens, it becomes necessary to perform a plurality of processing steps, each step is conducted at a different position on the face of the lens, or the processing must be conducted while the tool is moved when the chamfering area is great (or the curvature of chamfering is great). Therefore, problems arise in that the processing time increases and the control operation for the apparatus becomes complex and difficult.

The present invention has been made to overcome the above problems with the prior art lens processing apparatuses. One object of the present invention is to provide an apparatus for processing a lens that can achieve chamfering and grooving of a lens, in particular a lens having a small diameter, by using a simple mechanism that can achieve a desired chamfering in a short time.

SUMMARY OF THE INVENTION

The present invention provides an apparatus for processing a lens which comprises a finishing unit for chamfering and grooving a peripheral portion of a spectacle lens, the apparatus comprising: a holding shaft supporting the lens, a lens-holding unit that rotates the holding shaft and displaces the lens towards the finishing unit based on data describing a shape of a lens frame and a rotation angle of the holding shaft, and a means for positioning in an axial direction that displaces the lens in an axial direction of the holding shaft; wherein the finishing unit comprises a rotating tool for chamfering and a rotating tool for grooving that are disposed at positions separated by a prescribed distance along the holding shaft, and a single means for driving which is connected with the rotating tool for chamfering and the rotating tool for grooving, one of the rotating tool for chamfering and the rotating tool for grooving is selected in accordance with a displacement in the axial direction of the means for positioning in an axial direction, a prescribed position for processing or a prescribed processing amount is set in accordance with the displacement in the axial direction, and the finishing of the peripheral portion of the lens is conducted by using the rotating tool for grooving and the rotating tool for chamfering successively.

The present invention also provides an apparatus for processing a lens which comprises a rotating tool for chamfering used for chamfering a peripheral portion of a spectacle lens, the apparatus comprising: a holding shaft supporting the lens, a lens-holding unit which rotates the holding shaft and displaces the lens towards the finishing unit based on data describing a shape of a lens frame and a rotation angle of the holding shaft, and a means for positioning in an axial direction that displaces the lens in an axial direction of the holding shaft; wherein the rotating tool for chamfering includes a rotating tool having a hemispherical shape, a chamfering angle or a chamfering amount is set in accordance with a displacement in the axial direction of the means for positioning in an axial direction and a displacement of the lens-holding unit, and the chamfering angle or the chamfering amount can be changed in accordance with the relative position between the rotating tool having the hemispherical shape and the peripheral portion of the lens.

In the present invention, one of the rotating tool for chamfering and the rotating tool for grooving is selected by displacement of the lens-holding unit in the axial direction of the holding shaft and the lens-holding unit and the means for positioning in the axial direction are displaced towards the selected tool based on the data describing the shape of the lens frame. Therefore, the prescribed chamfering and the prescribed grooving of the peripheral portion of the lens can be conducted independently. Since the rotating tool for chamfering and the rotating tool for grooving are disposed independently at positions separated by a prescribed distance, interference of the rotating tool for grooving with the lens-holding shaft during the chamfering is prevented and the chamfering and the grooving can be reliably achieved even when the lens has a small diameter.

In the present invention, the rotating tool having the hemispherical shape and the lens are relatively displaced in the radial direction and in the axial direction by using the lens-holding unit and the means for positioning in the axial direction so that lens processing can be conducted at both a desired chamfering angle and a desired chamfering amount using a single tool. Therefore, by using the apparatus for lens processing in accordance with the present invention, the time required for lens processing can be decreased while the chamfering is conducted for various shapes.

In accordance with yet another embodiment, there is provided an apparatus for processing a lens. The apparatus comprises a finishing unit for chamfering and grooving a peripheral portion of a spectacle lens. A holding shaft is arranged to support the lens. A lens-holding unit is connected to rotate the holding shaft and displace the lens towards the finishing unit based on data describing a shape of a lens frame and a rotation angle of the holding shaft. A positioning device is connected to displace the lens in an axial direction of the holding shaft. The finishing unit further comprises a rotating tool for chamfering and a rotating tool for grooving, both tools being disposed at positions separated by a prescribed distance along the holding shaft, and a drive connected to drive the rotating tool for chamfering and the rotating tool for grooving, wherein one of the rotating tool for chamfering and the rotating tool for grooving is selected for finish processing in accordance with a displacement in the axial direction of the positioning device in an axial direction, and a prescribed position for processing, or a prescribed processing amount, set in accordance with displacement in the axial direction.

In a still further embodiment, the lens-holding unit is displaced freely in a vertical direction, the finishing unit is disposed at a position vertically above the holding shaft, and the positioning device is connected to position the lens relative to the rotating tool for chamfering and the rotating tool for grooving based on a first position in the axial direction determined in accordance with a rotating angle measured in advance based on data describing a shape of a lens frame.

In yet another embodiment, a first distance from the holding shaft to the rotating tool for grooving is set to be longer than a second distance from the holding shaft to the rotating tool for chamfering.

In another embodiment, the rotating tool for chamfering and the rotating tool for grooving are each disposed on a respective shaft standing in a direction perpendicular to the holding shaft.

In a still further embodiment, the rotating tool for chamfering includes a rotating tool having a hemispherical shape.

In another embodiment, the finishing unit is displacable between a first position for processing where the rotating tool for chamfering and the rotating tool for grooving face towards the holding shaft and a prescribed waiting position that is separated from the first position where the rotating tool for chamfering and the rotating tool for grooving face towards the holding shaft.

In yet another embodiment there is provided an apparatus for processing a lens comprising a rotating tool for chamfering a peripheral portion of a spectacle lens. In this embodiment, a holding shaft disposed to support the lens. A lens-holding unit is disposed to rotate the holding shaft and displace the lens towards the finishing unit based on data describing a shape of a lens frame and a rotation angle of the holding shaft. A positioning device is connected to displace the lens in an axial direction of the holding shaft. The rotating tool for chamfering includes a rotating tool having a hemispherical shape, wherein a chamfering angle, or a chamfering amount, is set in accordance with a displacement in the axial direction of positioning device in an axial direction and a displacement of the lens-holding unit.

In another embodiment, the rotating tool for chamfering is disposed in a direction perpendicular to the holding shaft and is fixed at a prescribed position during lens processing.

In yet another embodiment, the rotating tool for chamfering is displaced between a first position for processing where the rotating tool for chamfering faces towards the holding shaft and a prescribed waiting position that is separated from the first position where the rotating tool for chamfering faces towards the holding shaft.

In a still further embodiment, the drive includes a single motor, and the rotating tool for chamfering and the rotating tool for grooving are simultaneously driven by the single motor, and a transmission is provided connected to the single motor so that the single motor drives both the rotating tool for chamfering and the rotating tool for grooving.

Further objects, features and advantages of the present invention will become apparent from the Detailed Description of Illustrative Embodiments, which follows, when considered together with the attached Figures.

DETAILED DESCRIPTION OF THE ILLUSTRATIVE EMBODIMENTS OF THE INVENTION

An embodiment of the present invention will be described in the following with reference to the Figures, wherein like parts are represented by like character references.

Figure 1:
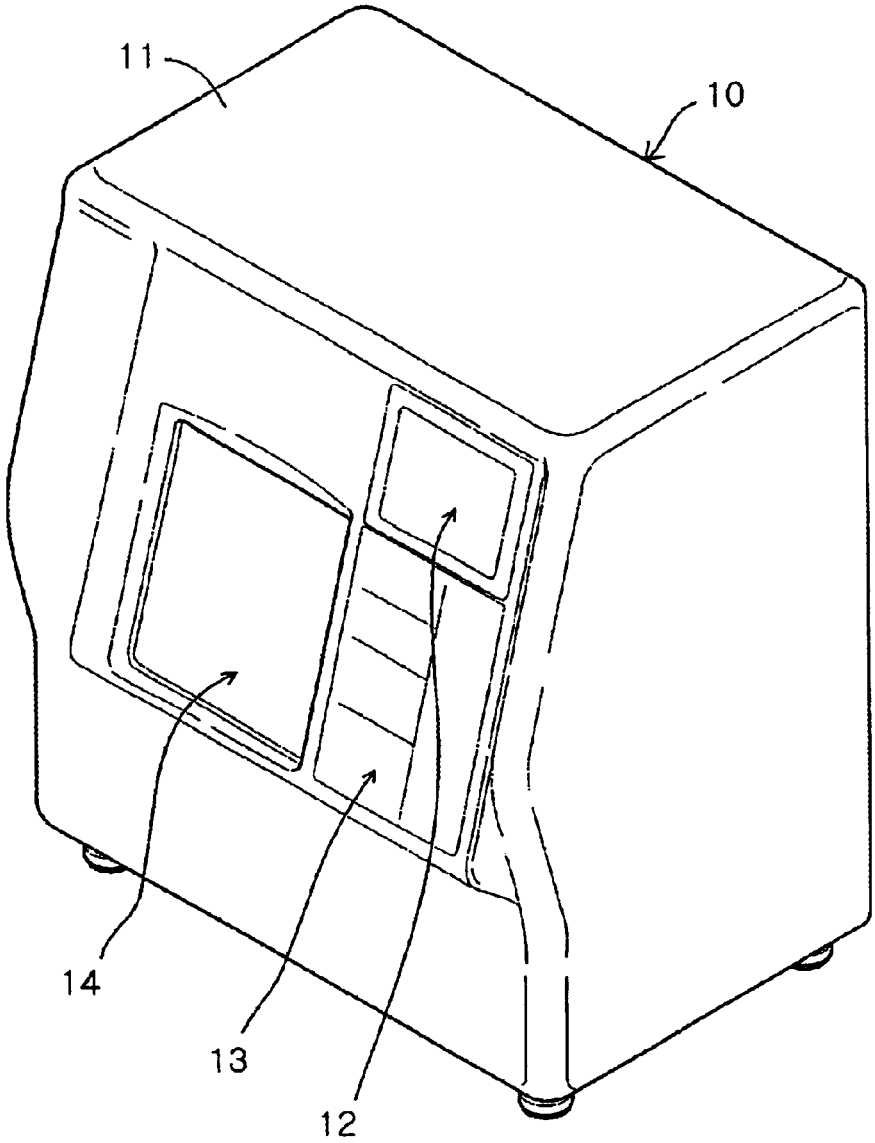
FIG. 1 is a perspective view of the lens processing apparatus according to an embodiment of the present invention.
Figure 2:
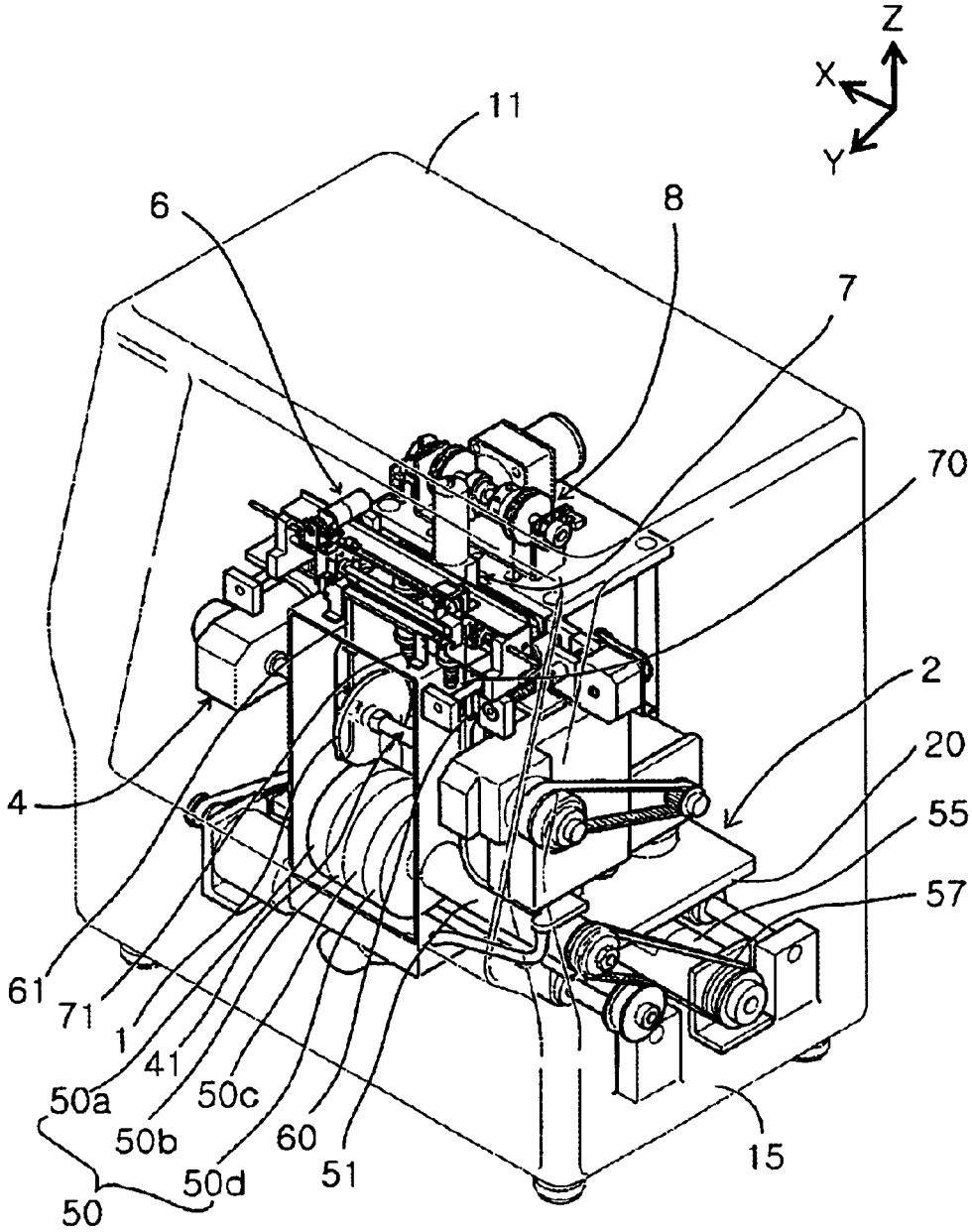
FIG. 2 is a perspective view exhibiting the main portions of the inner construction of the apparatus in FIG. 1.
Figure 3:
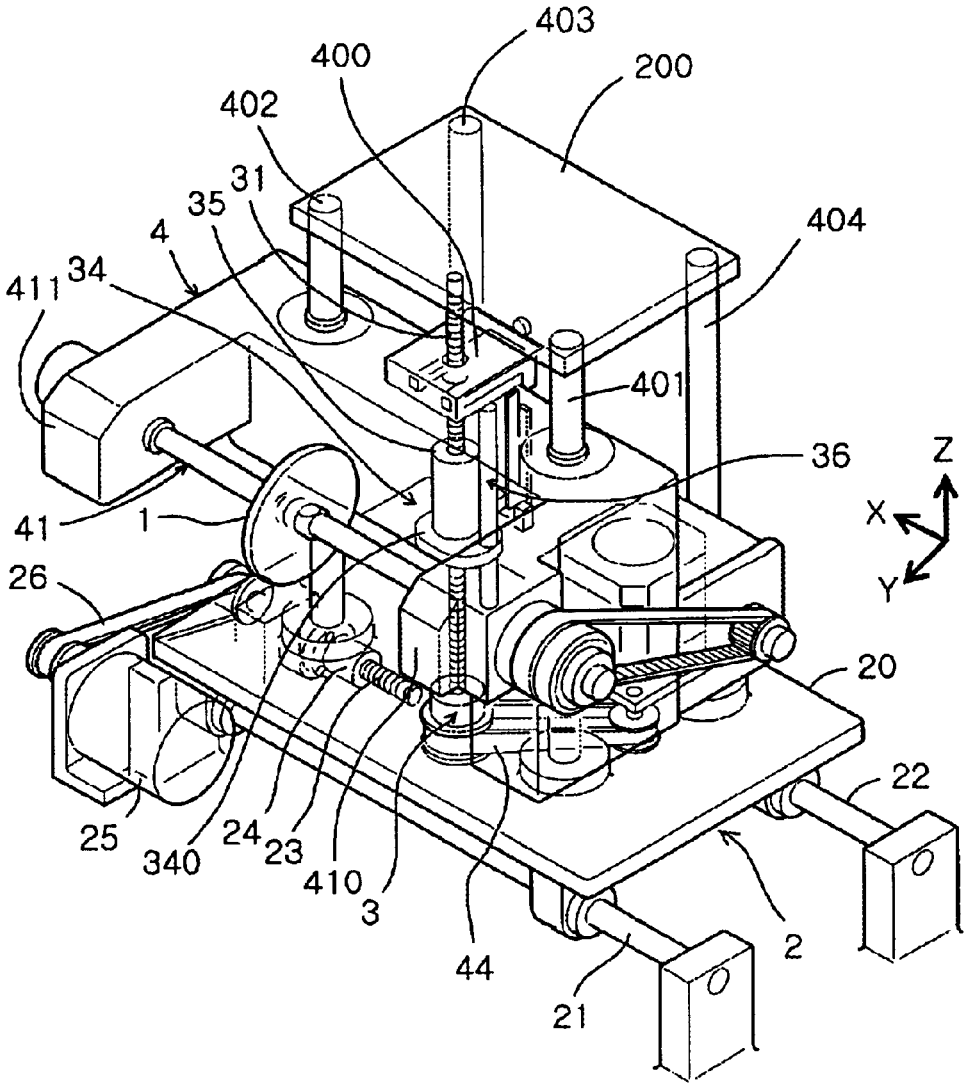
FIG. 3 is a perspective view exhibiting a base unit, an elevating and lowering unit and a lens unit in the inner construction shown in FIG. 2.

FIG. 1 is a perspective view of an apparatus 10 for processing a lens. FIGS. 2 and 3 show perspective views exhibiting the inner construction of the lens processing apparatus 10.

In FIG. 1, at the right side of the front of the lens processing apparatus 10, contained in a case 11 having the shape of a rectangular parallelepiped 11, is disposed an operation portion 13 for selecting or inputting the conditions for lens processing for the lens and a display portion 12 for displaying information on the processing, such as the data describing the shape of the lens frame and the processing data used for the processing. The operation portion 13 includes touch panels, touch switches, keys, other manual controls, or the like. The display portion 12 includes LCD, CRT, other display assemblies, and the like.

At the front center of the lens processing apparatus 10, a door 14 is disposed, which can be opened or closed as desired, and is used for inserting or taking out a lens.

After the interior construction of the lens processing apparatus 10 is generally described, various members and portions will be described in detail.

General Outline of the Interior Construction of the Lens Processing Apparatus

In FIGS. 2 and 3, a base unit 2, which is equipped with a main rotating tool 50 (also referred to as "a main means for processing") that can be displaced in the direction parallel to a main shaft 51 (i.e., the direction of the X-axis in FIGS. 2 and 3), is disposed inside of the case 11. The base unit 2 supports a lens unit 4 (also called a "a lens-holding unit"), which can be displaced in the vertical direction (i.e., in the direction of the Z-axis in the Figures).

Figure 4:
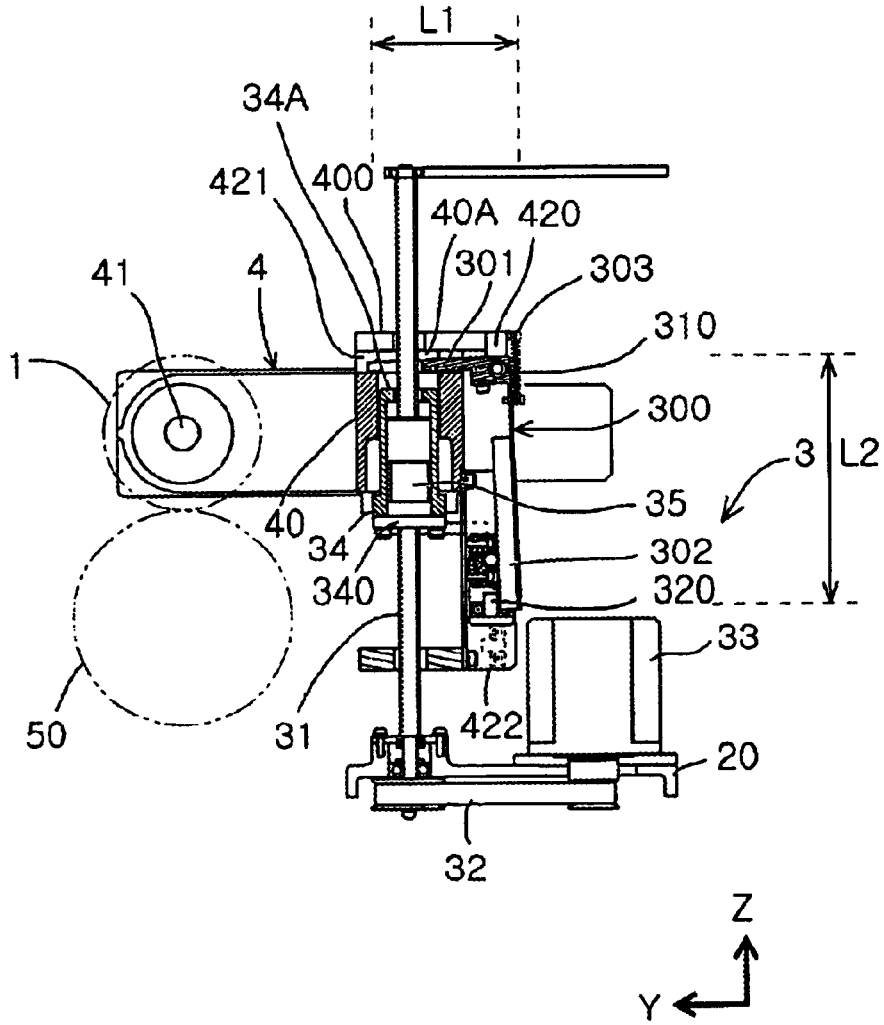
FIG. 4 is a sectional view of the elevating and lowering unit and the lens unit in the vertical direction when the processing is started.

The direction from the right to the left in FIG. 2 (i.e., the transverse direction of the apparatus for processing a lens 10) is assigned to the X-axis, the vertical direction (i.e., the direction of the height of the apparatus) is assigned to the Z-axis, and the direction from the left to the right in FIG. 4 (i.e., the direction towards the inside of the apparatus) is assigned to the Y-axis. It is assumed that these axes orthogonally intersect each other to provide a conventional Cartesian coordinate system.

The lens unit 4 includes a lens-holding shaft 41, which is divided into two portions 41R, 41L and selectively holds the center of the lens 1 between the two portions. The lens holding shaft 41 is disposed in a manner so that the lens-holding shaft can be rotated freely. The lens-holding shaft 41 is placed on the vertical line of the main rotating tool 50, which is a grinder or a cutter that is supported by a shaft on a base plate 15. The lens-holding shaft 41 and the main shaft 51 of the main rotating tool 50 are arranged parallel to each other along the X-axis. The lens 1 is held by the lens-holding shaft 41 in a manner so that the face of the lens 1 is placed along a plane perpendicular to the axial line of the lens holding shaft 41.

A measuring unit 6, comprising styluses 60 and 61 for measuring positions on the concave face 1*b* and the convex face 1*a*, respectively, of the lens 1, is fixed on the vertical line of the lens-holding shaft 41.

The styluses 60 and 61 can be displaced in a direction parallel to the lens-holding shaft 41. To measure the position of the lens 1 after processing is complete, the styluses 60 and 61 are brought into contact with both faces of the lens 1 when the lens unit 4 is in an elevated condition. The lens unit 4 is elevated or lowered in accordance with the data describing the shape of the lens frame while the lens-holding shaft 41 is rotated.

For processing the lens 1, starting from the condition shown in FIG. 2, the lens unit 4 is lowered after the main rotating tool 50 is rotated and the peripheral portion (i.e., the outer peripheral portion) of the lens 1 is ground into the prescribed shape by elevating or lowering the lens unit 4 in accordance with data describing the shape of the lens frame while the lens-holding shaft 41 is rotated.

By elevating or lowering the lens unit 4, based on the data describing the shape of the lens frame that is used to determine corresponding rotation angles for the lens-holding shaft 41, the grinding to the processing depth, in accordance with the rotation angle of the lens 1, is conducted in a continuous manner. During processing, the force pressing the lens 1 against the main rotating tool 50 is called the "processing pressure" and is provided by the weight of the lens unit 4 itself. Adjustment of the processing pressure is required depending upon the material of the lens, and such adjustment is conducted by supporting a portion of the weight of the lens unit 4 by a unit 8 for controlling the processing pressure that is disposed at a position above the lens unit 4.

The position of contact between the lens 1 and the main rotating tool 50 is changed by displacing the base unit 2 in the direction of the X-axis as evident from FIG. 2. By displacing base unit 2 in the direction of the X-axis, a selection between the flat grinding and the beveled grinding can be made depending upon whether one of grinders 50*a*, 50*b* or one of grinders 50*c*, 50*d* is in contact with lens 1. Likewise, switching between the rough grinding and the finishing grinding can also be made depending upon whether one of grinders 50*a*, 50*c* or one of grinders 50*b*, 50*d* is in contact with the lens 1.

Figure 9:
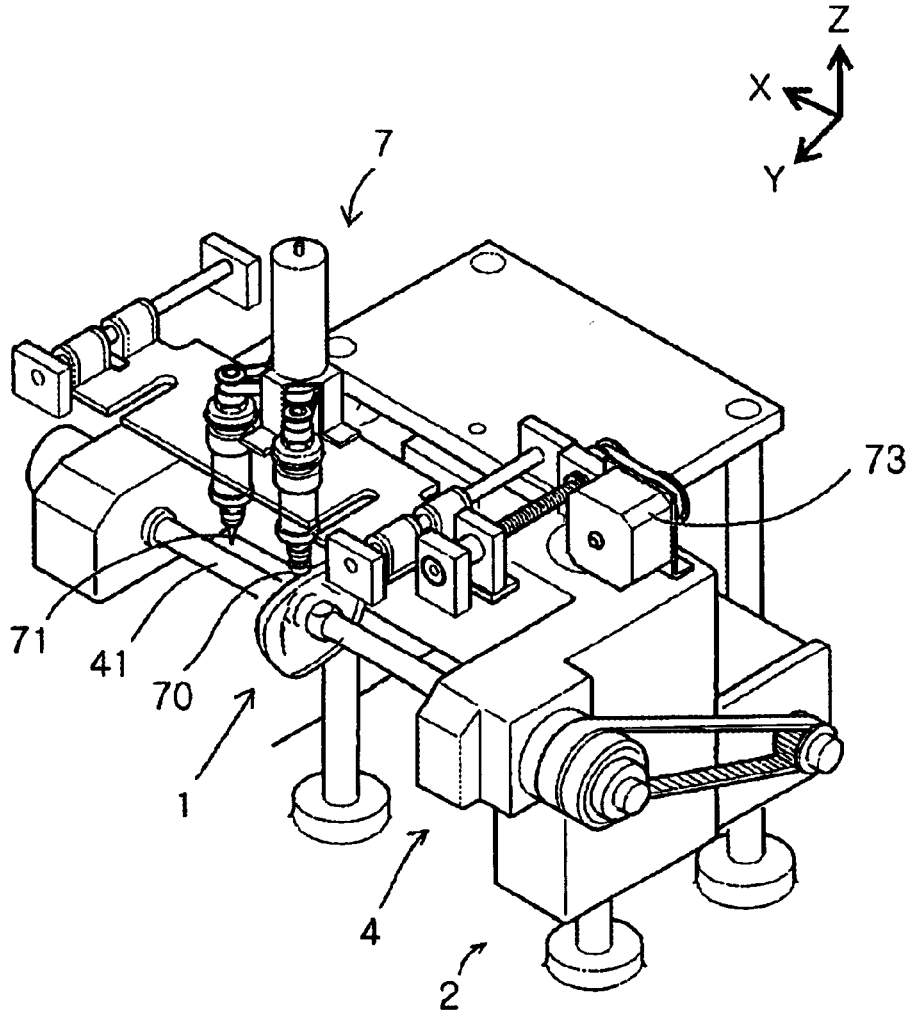
FIG. 9 is a perspective view of the finishing unit at the processing position (also called the "advanced position").

A finishing unit 7 (also referred to as "a means for finishing") comprises a rotating tool 70 for chamfering and a rotating tool 71 for grooving. Finishing unit 7 can be displaced in the direction of the Y-axis (i.e., in the inner direction of the apparatus) and is disposed at a position above the lens unit 4. When the finishing unit 7 is at the advanced position as shown in FIG. 9, the rotating tool 70 for chamfering and the rotating tool 71 for grooving are placed at a position directly above the lens-holding shaft 41. The selection between the rotating tools 70 and 71 is made depending upon whether chamfering or grooving is required, and the position of the processing is set by elevating the lens unit 4 in the direction of the Z-axis and driving the base unit 2 in the direction of the X-axis. Finishing is then conducted with the apparatus 10 in this condition.

Various portions of the inner construction of the lens processing apparatus 10 will be described in more detail as follows.

The Main Shaft Unit

In FIGS. 2, 3 and 4, the main shaft 51, upon which the rotating tool 50 (a grinder or a cutter having diamond or the like) is disposed, and a motor 55 for driving the main shaft 51 are fixed to the base plate 15 inside of the case 11. The main shaft unit includes main shaft 51, rotating tool 50, and motor 55 as the main components.

The main shaft 51, as shown in FIG. 2, is supported by a shaft mounted on the base plate 15 along the X-axis in a manner that allows the main shaft 51 to be rotated freely around the support shaft. Main shaft 51 is disposed to be parallel with the lens-holding shaft 41.

At the end portion of the main shaft 51, a main rotating tool 50 for mechanically processing the lens 1 is attached. The main rotating tool 50 is placed at the central portion of the apparatus 10 in the direction of the X-axis as shown in FIG. 2 and at the front side of the apparatus 10 (i.e., at the lower left side in FIG. 4). The base end portion of the main shaft 51 (located at the right side in FIG. 2) is driven by a motor 55 via a belt 57 and pulleys.

As shown in FIG. 2, the main rotating tool 50, which mechanically processes the lens 1, includes a rough grinder 50*a* for flat grinding, a finishing grinder 50*b* for flat grinding, a rough grinder 50*c* for beveled grinding and a finishing grinder 50*d* for beveled grinding, each disposed successively from the side of the tip of the main shaft 51 (i.e., from the left side in FIG. 2). In the alternative, grinding may also be conducted by using cutters as the rotating tool in place of the grinders without departing from the scope of the present invention.

The Base Unit

A base unit 2 for driving the lens unit 4 in the direction of the X-axis is disposed at a position posterior to the main shaft 51 in FIG. 2 (i.e., in the direction of the Y-axis, at the right side in the Figure).

As shown in FIG. 3, the base unit 2 includes a base 20, which can be displaced in the direction of the X-axis, and a servomotor 25 (hereinafter, referred to as the "X-axis motor"), which controls the positioning by driving the base 20 by driving the base 20 in the direction of the X-axis.

The base 20 is disposed on guide members 21 and 22, which are fixed on the base plate 15 and oriented along the direction of the X-axis in a manner such that the base 20 can be freely displaced along the X-axis. Therefore, the base 20 can be freely displaced in the direction of the X-axis.

As shown in FIG. 3, an inner screw 23 is disposed at a position below the base 20 and between the guide members 21 and 22 in a manner such that the inner screw 23 can be rotated freely about its own axis. An outer screw 24 fixed at the lower face of the base 20 is engaged with the inner screw 23 and the base 20 is driven in the direction of the X-axis by rotation of the screw 23. Screw 23 is driven to rotate by the X-axis motor 25.

One end of the inner screw 23 and the X-axis motor 25 are connected to each other via a gear and a cogged belt 26, and the base 20 is positioned in the direction of the X-axis in accordance with the rotation angle of the X-axis motor 25.

The Elevating and Lowering Unit

As shown in FIG. 3, four poles 401, 402, 403, and 404 stand on the base 20. Among the four poles, the two poles 401 and 402 penetrate a frame 40 of the lens unit 4 so as to guide the lens unit 4 in the vertical direction (i.e., the direction of the Z-axis) in a manner such that the lens unit 4 can be displaced freely in the vertical direction.

As shown in FIGS. 3 and 4, the lens unit 4 is driven in the vertical direction and positioned in the vertical direction by the elevating and lowering unit 3, which is displaced in the direction of the Z-axis. On the other hand, the lens unit 4 is positioned in the direction of the X-axis by the base unit 2 as discussed above.

Figure 6:
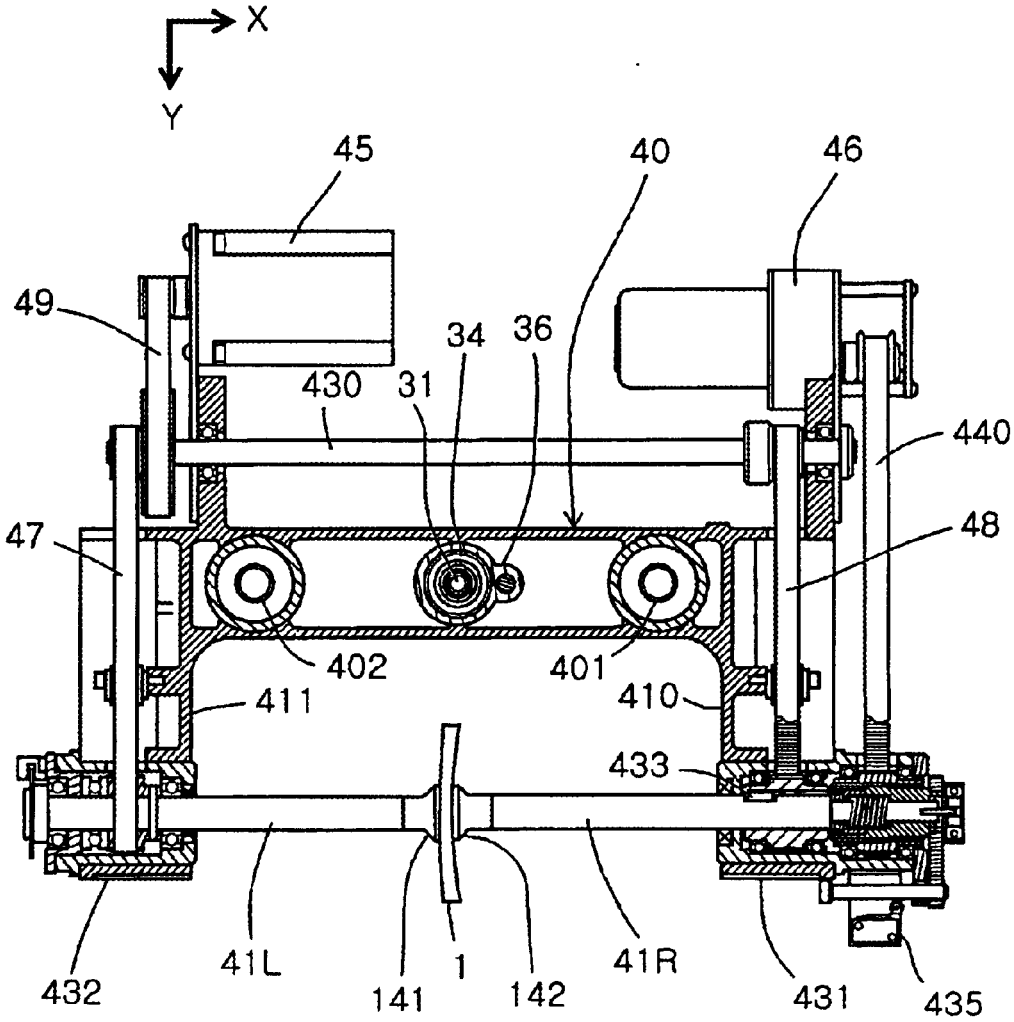
FIG. 6 is a sectional view of the elevating and lowering unit and the lens unit in the horizontal direction in the condition that the lens is held by the lens-holding shafts (this is the "lens holding condition").

The elevating and lowering unit 3, as shown in FIGS. 3, 4 and 6, includes the following: a screw 31, which is supported by a shaft on the base 20 between the poles 401 and 402 and penetrates the frame 40 of the lens unit 4 in the vertical direction; a positioning member 34, which is engaged with the screw 31 at the inner peripheral portion of the positioning member and which can support the lens unit 4 by contacting the frame 40 of the lens unit 4 at the upper end of the positioning member; and a servomotor 33 (hereinafter, referred to as a "Z-axis motor"), which is connected to the lower end of the screw 31 via a cogged belt 32 and a gear. The elevating and lowering unit 3 is disposed on the base 20.

In the elevating and lowering unit 3, the screw 31 is rotated by driving the Z-axis motor 33 so that the positioning member 34, having an outer screw 35 engaged with the screw 31, is driven in the direction of the Z-axis. The outer screw 35 is displaced in the direction of the Z-axis because the rotating movement in the circumferential direction is restricted by a mechanism at the lens unit 4, as is discussed later.

As shown in FIG. 4, the positioning member 34 contacts the inner periphery of a hole portion 40A formed in the frame 40 of the lens unit 4. The contact between the positioning member 34 and the inner periphery of the hole portion 40A occurs in the vertical direction in a manner so that the positioning member 34 can slide and make a relative displacement in the vertical direction within the hole portion 40A.

At the upper end of the hole portion 40A, a ceiling portion 400 connected to the frame 40 is disposed. As shown in FIGS. 3 and 6, along side of the outer screw 35 of the positioning member 34, a stopper 36 standing in the direction of the Z-axis is disposed at a position so that the stopper 36 can contact the lower face of the ceiling portion 400.

In FIG. 3, the stopper 36 is shown protruding from the upper portion of the positioning member 34 and contacts the lower face of the ceiling portion 400 so that the weight of the lens unit 4 applied by the ceiling portion 400 is supported by the positioning member 34, which includes both the stopper 36 and the outer screw 35. The outer screw 35 and the stopper 36 are connected to each other at each base portion through a base 340 of the positioning member 34.

As evident from FIG. 6, the hole portion 40A of the frame 40 has a sectional shape such that the positioning member 34 and the stopper 36 fix each other around the Z-axis (i.e., in the direction perpendicular to the plane of FIG. 6) so that idle rotation of the outer screw 35 by the rotation of the screw 31 is prevented. In other words, the stopper 36 is fixed at the side of the outer screw 35 and connected to the outer screw 35 by base 340. Stopper 36 is arrested by the hole portion 40A so the rotation of the positioning member 34 is also prevented. Thus, the outer screw 35 is elevated or lowered by the rotation of the screw 31 and the positioning member 34 is displaced in the direction of the Z-axis due to this movement of the outer screw member 35.

Figure 5:
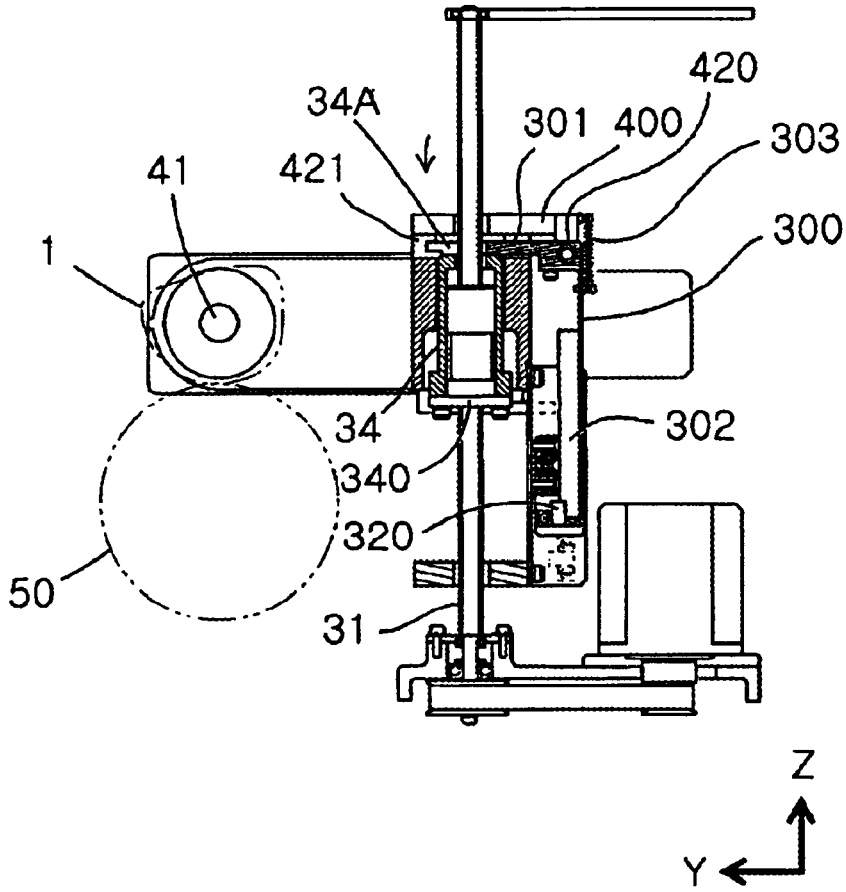
FIG. 5 is a sectional view of the elevating and lowering unit and the lens unit in the vertical direction at the moment in time when the processing is completed.

When the stopper 36 does not contact the ceiling portion 400, the lens 1 supported by the lens unit 4 is brought into contact with the main rotating tool 50, as shown in FIG. 5, and the weight of the lens unit 4 itself is applied as the processing pressure. The upper end face 34A of the positioning member 34 and the lower face of the ceiling portion 400 do not contact each other under these circumstances. Consequently, a prescribed gap is formed between the upper end face 34*a* of the positioning member 34 and the lower face of the ceiling portion 400.

At a position below the ceiling portion 400 and facing the gap, a hole portion 421 is provided in frame 40. A sensor arm 300 for detecting completion of the processing on the lens unit 4, in the vertical direction, is also provided. The sensor arm 300 may be referred to as the "means for amplifying a relative displacement." An end of the sensor arm 300 is inserted into the hole portion 421 and is disposed along the Y-axis, as shown in FIG. 4, in a manner such that the hole portion 421 penetrates the frame 40 across the hole portion 40A. In other words, hole portion 421 and hole portion 40A are contiguous.

The sensor arm 300, as shown in FIGS. 4 and 5, is an integrally formed arm having the shape of an inverse L, which is composed of an arm 301 extending to the left side in the Figures (in the direction of the Y-axis) and that inserts into the hole portion 421, and an arm 302 extending in the lower direction in the Figure (in the direction of the Z-axis, to the side of the base 20). The arm 301 and the arm 302 are disposed approximately perpendicularly to each other. The length of the arm 302 in the vertical direction is set longer than that of the arm 301 in the horizontal direction.

A bending portion 303, located at the middle of the sensor arm 300 having the shape of an inverse L, is supported by a shaft 420 disposed by the ceiling portion 400 of the lens unit 4 in a manner so that the bending portion 303 can freely swing around the shaft 420. Therefore, the sensor arm 300 can swing around the X-axis.

Between the arm 302 extending in the direction of the Z-axis and the ceiling portion 400, a spring 310 is disposed, which pushes or biases the arm 301 that extends in the direction of the Y-axis to rotate towards the lower direction in FIGS. 4 and 5 (i.e., to rotate in the counter-clockwise direction about shaft 420 shown in the Figures).

Since the arm 301 inserted into the hole portion 421 and crosses the hole portion 40A in the direction of the Y-axis, arm 301 is constructed to include a penetrating portion through which the screw 31 inserts. Furthermore, arm 301 is connected so that the lower face of the arm 301 faces towards the inner periphery of the hole portion 40A so that the lower face of the arm 301 can be brought into contact with, or separated, from the upper end face 34A of the positioning member 34.

Since the sensor arm 300 is pushed in the counter-clockwise direction, as evident in FIG. 4, by the spring 310, the tip 301A of the arm 301 is brought into contact with the lower side of the hole portion 421 and stops there when the upper end face 34A of the positioning member 34 and the arm 301 are separated from each other (this is the condition whenever the stopper 36 is separated from the ceiling 400).

On the other hand, as shown in FIG. 5, when the stopper 36 of the positioning member 34 contacts the ceiling portion 400 of the lens unit 4, the positioning member 34 supports the lens unit 4, and the upper end face 34A of the positioning member 34 pushes the arm 301 in the upper direction (i.e., clockwise). In other words, when stopper 36 contacts ceiling portion 400, the positioning member 34 contacts the arm 301 and pushes the arm in the clockwise direction about shaft 420 in a pivotal manner. When this occurs, the sensor arm 300 rotates and the arm 302 extending in the direction of the Z-axis is placed at the prescribed position (for example, a position in the vertical direction as shown in FIG. 5).

A bracket 422 protruding along the lower portion (i.e., arm 302) of the sensor arm 300 is disposed at the frame 40. At a prescribed position of the bracket 422, which can face to the lower end of the arm 302 that swings around the X-axis, a sensor 320 is disposed at a position located approximately below the shaft 420. Sensor 320 is for detecting completion of the processing (also referred to as a "means for detection") by detecting the approach of the free end portion of the arm 302 swinging around the X-axis. The "free end portion" of sensor 320 is defined to be the end portion of the sensor arm 300 that is detected by the sensor 320 for detecting completion of the processing. In the present embodiment, the "free end portion" corresponds to the end portion of the arm 302.

The sensor 320 for detecting completion of the processing is, for example, constructed to include a photosensor, such as a photointerruptor. As shown in FIG. 5, when the swinging arm 302 comes to the prescribed position (i.e., the position in the vertical direction where the lens unit 4 and the positioning member 34 are brought into contact with each other) and the light of the photointerruptor of the sensor 320 for detecting completion of the processing is interrupted, the sensor 320 is switched to ON so as to detect that processing has been completed. The prescribed position wherein the sensor 320 detects the presence of the free end portion of the sensor arm 300 is referred to as the "position of detecting the arm" or the "position detecting the completion of processing."

The elevating and lowering unit 3 supports the lens unit 4 in the elevating direction. After the lens unit 4 starts the processing of the lens 1, the processing depth, (also called the processing amount), is decided in accordance with the position of the elevating and lowering unit 3 in the direction of the Z-axis. In other words, movement of the lens unit 4 by the elevating and lowering unit 3 is the manner in which apparatus 10 directs the processing depth, whereas movement of the lens unit 4 from an initial lens processing position shown in FIG. 4 (i.e., the upper face 34A of positioning member 34 is separated from the inner periphery of the hole portion 40A) to a completed lens processing position shown in FIG. 5 (i.e., the upper face 34A of positioning member 34 is in contact with the inner periphery of the hole portion 40A) occurs during actual lens grinding or cutting. When the prescribed processing depth is achieved, the sensor for detecting completion of the processing 320 is switched to ON. The progress of processing can be detected at every rotation angle of the lens 1 by following this procedure so that when the output of the sensor 320 for detecting completion of the processing shows ON at the entire peripheral portion of the lens 1, the apparatus 10 decides that the processing has been completed on the entire peripheral portion of the lens 1.

The Lens Unit

The lens unit 4 that is displaced by the elevating and lowering unit 3 in the direction of the Z-axis, as shown in FIG. 3, is guided by the two poles 401 and 402 standing on the base 20 in the vertical direction (i.e., in the direction of the Z-axis) in a manner such that the lens unit 4 can be freely displaced. Lens unit 4 is constructed to include the lens-holding shaft 41, which is divided into two portions 41R and 41L, a motor 45 for driving the lens that rotates the lens-holding shaft 41, and a motor 46 for the lens chuck that changes the holding pressure of the lens-holding shaft 41 that holds the lens 1.

As shown in FIG. 4, the lens-holding shaft 41 that holds and rotates the lens 1 is placed at a position directly above the main rotating tool 50. The vertical direction connects the axial line of the lens-holding shaft 41 and the axial line of the main shaft 51 as shown in FIG. 4.

Connected to the frame 40 of the lens unit 4, as shown in FIGS. 3 and 6, are arms 410 and 411 disposed to protrude in the direction towards the front of the apparatus 10 (i.e., to the lower left side of FIG. 3). Frame 40 and the arms 410 and 411 form a rectangle having three sides that is open to one side (i.e., "C"-shaped). The arms 410 and 411 support the lens-holding shaft 41.

As shown in FIGS. 3 and 6, the lens-holding shaft 41 is divided at its center into two shaft portions 41R, 41L, which include a pushing or pressing shaft 41R supported by the arm 410 and a holding shaft 41L supported by the arm 411. The shaft 41L is supported by the arm 411 at the left side in FIG. 6 in a manner that allows shaft 41L to be freely rotated. The shaft 41R is supported by the arm 410 at the right side in FIG. 6 in a manner that allows the shaft 41R to be freely rotated and to be displaced in the axial direction (i.e., in the direction of the X-axis).

The shafts 41L and 41R are rotated by the motor 45 for driving the lens via cogged belts 47, 48 and 49. The cogged belts 47 and 48 are connected to each other through a rotatable shaft 430 so that the rotation angles of the shafts 41L and 41R are synchronized.

To achieve this synchronization, a gear 432 is engaged with the cogged belt 47 and is fixed to the shaft 41L and a gear 431 is engaged with the cogged belt 48 and is fixed to the shaft 41R. So that the shaft 41R can be axially displaced, relative to the arm 410, in the direction of the X-axis, the shaft 41R is arrested in the direction of rotation by the key 433 disposed between the shaft 41R and the inner periphery of the gear 431. Key 433 can be relatively displaced in the direction of the X-axis, and moves along with shaft 41R when displaced in the X-axis.

As shown in FIG. 6, a chuck mechanism driven by a motor 46 for the lens chuck is disposed at the end portion (i.e., at the right side in the Figure) of the shaft 41R.

Figure 7:
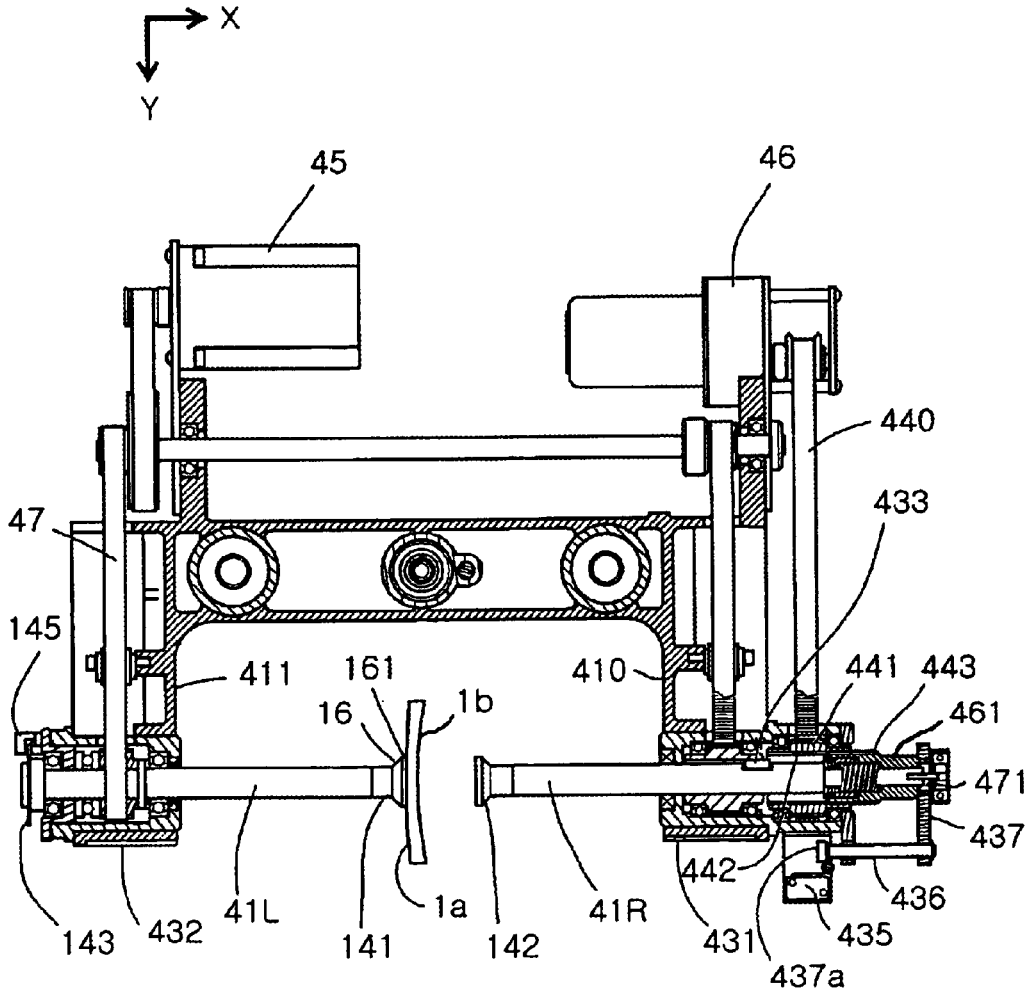
FIG. 7 is a sectional view of the elevating and lowering unit and the lens unit in the horizontal direction in the condition that the lens is released from the lens-holding shaft (this is the "lens releasing condition").

In the chuck mechanism, as shown in FIG. 7, an outer screw 442 is formed at the inner periphery of a gear 441 engaged with the cogged belt 440. The outer screw 442 is engaged with an inner screw portion 443 formed at a driving member 461, which can be brought into contact with the shaft 41R in the axial direction.

The position of rotation of the shaft 41R is decided by the motor 45 for driving the lens that is connected to the cogged belt 48. As for determining the position of the shaft 41R in the axial direction, as will be described later, gear 441 is rotated by the rotation of the motor 46 for the lens chuck, which causes the inner screw portion 443 of the driving member 461 engaged with the outer screw 442 to be displaced in the axial direction. Due to this axial displacement, the shaft 41R is pushed in the direction of the X-axis by the driving member 461 and the end portion of the shaft 41R is brought into contact with the lens 1 as shown in FIG. 6. The pressure with which the shaft 41R and the shaft 41L hold the lens 1 is called the "holding pressure," and can be set at a desired value by the motor 46 for the lens chuck. In the present embodiment, the holding pressure for the lens 1 is set by the value of the electric current driving the motor 46 for the lens chuck. Therefore, control of the electric current controls the motor 46 thereby setting the value of the holding pressure.

In FIG. 7, a receiver 141 of the lens holder is fixed at the tip of the left shaft 41L of the lens-holding shaft 41. To the receiver 141 of the lens holder, a lens holder 16 attaches. Prior to attaching lens holder 16 to the receiver 141, a lens 1 to be processed is fixed in advance to the lens holder 16. The lens holder 16 can be attached or released freely from receiver 141 and from lens 1.

On the other hand, the shaft 41R, disposed on the same axial line as that of the shaft 41L, moves in the direction of the X-axis and holds the lens at the tip. In other words, the shaft 41R moves towards the lens 1 by being driven by the motor 46 for the lens chuck and presses the lens 1 with a lens presser 142 disposed at the tip of shaft 41R. The lens 1 is pressed towards the lens-holding shaft 41L and held between the two shafts 41R, 41L by the holding pressure generated by motor 46. The lens presser 142 is made of a resin, such as rubber, having elasticity so as to prevent damage to the lens 1.

At the end face of the lens holder 16, which is formed into a concave shape, the convex face 1*a* of the lens 1 is coaxially adhered via a double faced adhesive pad 161 and the lens presser 142 presses the concave face 1*b* of the lens 1. The lens presser 142 is attached to the tip of the shaft 41R so as to hold the lens 1 in a manner whereby the lens presser can be swung in any desired direction and the concave face 1*b* of the lens 1 is still pressed with excellent balance without any adverse local concentration of pressure on the lens.

As evident from FIG. 7, which illustrates the starting condition wherein lens 1 is fixed to the lens holder 16 attached to the shaft 41L, the lens 1 is held by the lens presser 142 in the following manner: (a) the motor 46 for the lens chuck is driven in the prescribed direction (i.e., the positive rotation); (b) the gear 441 is rotated in the positive direction due to this movement of the motor 46; and (c) the shaft 41R is displaced towards the left side in FIG. 9 by the relative rotation of the outer screw 442 at the inner periphery of the gear 441 and the inner screw portion 443 of the shaft 41R. A sensor rod 436 is connected to the driving member 461 having the inner screw portion 443. The sensor rod 436 is placed parallel with the shaft 41R using a plate 437 disposed at the end portion of the driving member 461, and protruding to the side of the pushing shaft 41R. Sensor rod 436 prevents rotation of the inner screw 443 because the sensor rod 436 is arrested in the direction of rotation by the plate 437 disposed at the end portion of the driving member 461 so that the driving member 461 is driven in the axial direction alone.

To displace the shaft 41R in the direction of the X-axis and towards the left side of FIG. 7 to achieve the lens holding condition, the driving member 461 pushes the shaft 41R, which is thereby displaced in the direction of the X-axis until it presses the lens presser 142 to the concave face 1*b* of the lens 1.

When the motor 46 for the lens chuck is further rotated, even though the lens presser 142 is in contact with the concave face 1*b* of the lens, the force for pressing (i.e., the lens holding pressure) the lens 1 increases and the electric current consumed by the motor 46 for the lens chuck increases. The pressure of holding the lens (also referred to as the lens holding pressure) is set at a desired value by detecting the electric current consumed by the motor 46.

On the other hand, when the processing is completed, the motor 46 for the lens chuck is rotated in the reverse direction and the shaft 41R is driven to the right side in FIG. 6, which illustrates the lens releasing condition. Under the lens releasing condition, the lens presser 142 is separated from the lens 1 and a prescribed gap is formed between the lens 1 and the lens presser 142 as shown in FIG. 7. The shaft 41R is displaced to the waiting position which allows attachment and detachment of the lens 1 and the lens holder 16 from the receiver 141. When the driving member 461 is displaced in the direction of the right side in the Figure by a snap ring 471, or the like, disposed at a shaft portion 470 having a small diameter, which protrudes from the right tip of the shaft 41R to the right side in FIG. 7, the shaft portion 470 is pulled by the driving member 461 and displaced to the right side as shown.

Because the pushing shaft 41R of the lens-holding shaft 41 is displaceable in the axial direction of the X-axis, it is necessary to have a mechanism that can determine the position of the shaft 41R. When the shaft 41R moves towards the lens 1, as shown in FIG. 6, the position of shaft 41R is detected by a sensor not shown in the Figure that detects when the lens-holding shaft 41 contacts the lens 1, and the lens holding pressure is determined by monitoring the electric current consumed by the motor 46 for the lens chuck. However, when the shaft 41R moves to the right side towards the waiting position shown in FIG. 7, the prescribed waiting position is detected by a limit switch 435 disposed close to the arm 410 of the lens unit 4. Specifically, limit switch 435 detects the detecting portion 437*a* of the sensor rod 436 as it moves along with plate 437 and shaft 41R to the waiting position shown in FIG. 7.

In FIG. 7, the limit switch 435 is shown fixed to the arm 410 at the position supporting the gear 441.

At the right end portion of the shaft 41R, a sensor rod 436 is disposed via a plate 437 so as to be parallel with the shaft 41R. Sensor rod 436 protrudes along side of the shaft 41R. At the end portion of the sensor rod 436, there is formed a detecting portion 437*a*, which can contact the limit switch 435 at the prescribed waiting position.

When the shaft 41R moves to the right side shown in the FIG. 7, the sensor rod 436 is fixed to the shaft 41R and also moves to the right side. As shown in FIG. 7, the position where the detecting portion 437*a* contacts the limit switch 435 corresponds to the waiting position of the shaft 41R, and the limit switch 435 is switched to ON at this position.

To determine the processing depth in accordance with the rotation angle of the lens 1, the shaft 41L is constructed to penetrate the arm 411 and a slit plate 143 that is fixed at the end portion of the shaft 41L protrudes from the arm 411. By detecting the position of rotation of the slit plate 143 using a photosensor 145 (i.e., a lens position sensor; also referred to as a "means for detecting the angle") fixed to the arm 411, the position (i.e., the rotation angle) of the lens 1 held by the lens-holding shaft 41L is detected (i.e., measured).

In the lens unit 4 having the construction described above, when the lens 1 is fixed at the receiver 141 of the lens holder, the motor 46 for the lens chuck is driven and the lens-holding shaft 41R is moved towards the left side of FIG. 7. The lens 1 is then held, or fixed under pressure, when the lens presser 142 presses against the lens 1.

As evident from FIG. 3, the main rotating tool 50 is fixed to the base plate 15 and is not displaced. The lens 1 supported by the lens unit 4 is displaced in the vertical direction relative to the main rotating tool 50 by the displacement of the elevating and lowering unit 3 in the direction of the Z-axis so that the processing can be conducted to the desired processing depth.

The position of the lens 1 for processing can be changed by changing the rotation angle of the motor 46 for driving the lens so that the peripheral portion of the lens can be processed to the desired processing depth.

The tool used for processing can be changed by changing the position of contact between the lens 1 and the main rotating tool 50 by adjusting the displacement of the base 20 in the direction of the X-axis. In other words, by moving base 20 in the direction of the X-axis, one of the grinders 50*a*, 50*b*, 50*c*, and 50*d* can be selected for use in processing.

The Finishing Unit

In FIG. 2, the finishing unit 7, which can be displaced in the direction of the Y-axis (i.e., in the direction of the inner side of the apparatus), is disposed at a position above the lens-holding shaft 41 (i.e., at the right side in FIG. 2).

Figure 8:
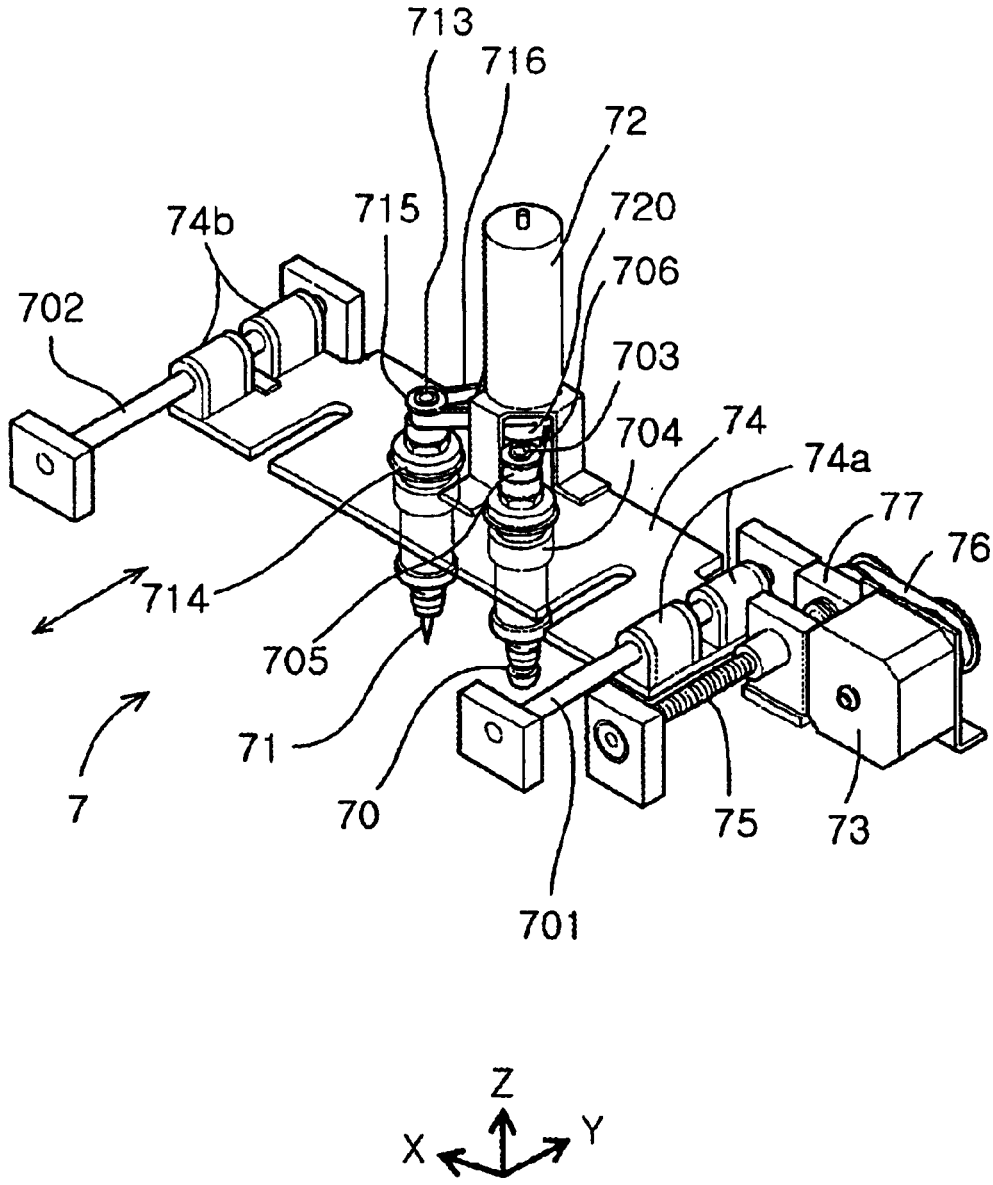
FIG. 8 is a perspective view of the finishing unit at the waiting position (also called the "retired position").

The finishing unit 7, as shown in FIGS. 2 and 8, is constructed with (a) a base 74 that can be displaced in the direction of the Y-axis, (b) a rotating tool 70 for chamfering the peripheral portion of the lens 1, (c) a rotating tool 71 for grooving the outer peripheral face of the lens 1, (d) a motor 72 for finishing that drives these rotating tools 70 and 71, and (e) a motor 73 for driving the finishing unit that drives the base 74 in the direction of the Y-axis. These components are disposed at positions above the frame (unlabeled) which stands on the base plate 15.

The rotating tools 70 and 71 stand in the direction of the Z-axis and are disposed at positions separated by the prescribed distance in the direction of the X-axis along the lens-holding shaft 41. Rotating tools 70 and 71 are each supported by a shaft on the base 74.

As shown in FIG. 8, a pair of guide shafts 701 and 702 are fixed to the tool frame (unlabeled) shown in FIG. 2 at positions separated by the prescribed distance in the directions of the Y-axis and oriented so that the shafts 701 and 702 are parallel with each other. The guide shafts 701 and 702 pass through holes penetrating stopping members 74*a* and 74*b*, respectively. Stopping members 74*a* and 74*b* are disposed at the right side and the left side of the base 74, and the right side and the left side of the base 74 are supported so that base 74 can be displaced in the direction of the Y-axis.

At the right side of FIG. 8, a screw 75 is supported by a shaft running parallel with the guide shaft 701 at the tool frame placed on the base plate 15. Screw 75 is driven by the motor 73 for driving the finishing unit via a belt 76.

To the stopping member 74*a*, through which penetrates the guide 701, a driving member 77 is fixed. Driving member 77 is engaged with the screw 75 at an outer screw formed at the inner periphery of the driving member. The base 74 is driven in the direction of the Y-axis when the driving member 77 is displaced in the direction of the Y-axis in accordance with the rotation of the screw 75.

The rotating tool 70 for chamfering the lens 1 is constructed to include a grinder (or a cutter) having the hemispherical shape with a radius R. The rotating tool 71 for chamfering, as shown in FIG. 8, is fixed at a lower end of a shaft 703, which is disposed in the vertical direction. The shaft 703 is supported by a bearing 704 disposed on the base 74. A pulley 705 is fixed at the upper end of the shaft 703. The pulley 705 is connected through a belt 706 to a pulley 720 of the motor 72 (i.e., a drive including a single motor) for finishing so as to be rotated by motor 72. The pulleys 705, 720 and belt 706 provide a means for transmission between motor 72 and shaft 703.

The rotating tool 71 for grooving the lens 1 is constructed to include an end mill having a narrowed tip. This rotating tool 71, as shown in FIG. 8, is fixed at the lower end of a shaft 713 that is disposed in the vertical direction. Shaft 713 is supported by a bearing 714 disposed on the base 74. A pulley 715 is fixed at the upper end of the shaft 713. The pulley 715 is connected through a belt 716 to a pulley 720 of the motor 72 for finishing so as to be rotated by the motor 72. The pulleys 715, 720 and belt 716 provide a means for transmission between motor 72 and shaft 713.

These rotating tools may be placed so that the distance in the direction of the Z-axis from the base 74 to the tip of each tool is set at the same value. Alternatively, these rotating tools may be placed so that the distance in the direction of the Z-axis from the base 74 to the tip of the rotating tool for grooving 71 may be set shorter than the distance from the base 74 to the tip of the rotating tool 70 for chamfering so that the rotating tool 71 for grooving does not interfere with the lens-holding shaft 41 or the receiver 141 of the lens holder during the chamfering. In other words, the distance from the main shaft 51 to the tip of the rotating tool 71 for grooving may be set at the same value with, or longer than, the distance from the main shaft 51 to the tip of the rotating tool 70 for chamfering.

Since two belts 706, 716 are wound around the pulley 720 of the motor 72 for finishing, the belts 706 and 716 are disposed at offset positions in the direction of the Z-axis. As shown in FIG. 8, a belt 716 is for driving the end mill and is wound at an upper position of the pulley 720. Belt 706 is for driving the rotating tool 70 that has the spherical shape and this belt is wound at a lower position of the pulley 720. Thus, the two rotating tools 70 and 71 are driven by one motor 72.

As shown in FIGS. 2 and 8, the finishing unit 7 is placed at the prescribed waiting position where processing is not conducted. In this condition, the two rotating tools 70 and 71 are placed at inner positions within the apparatus 10 (i.e., at the right side in FIG. 3) relative to the lens 1 and the styluses 60 and 61.

Figure 14:
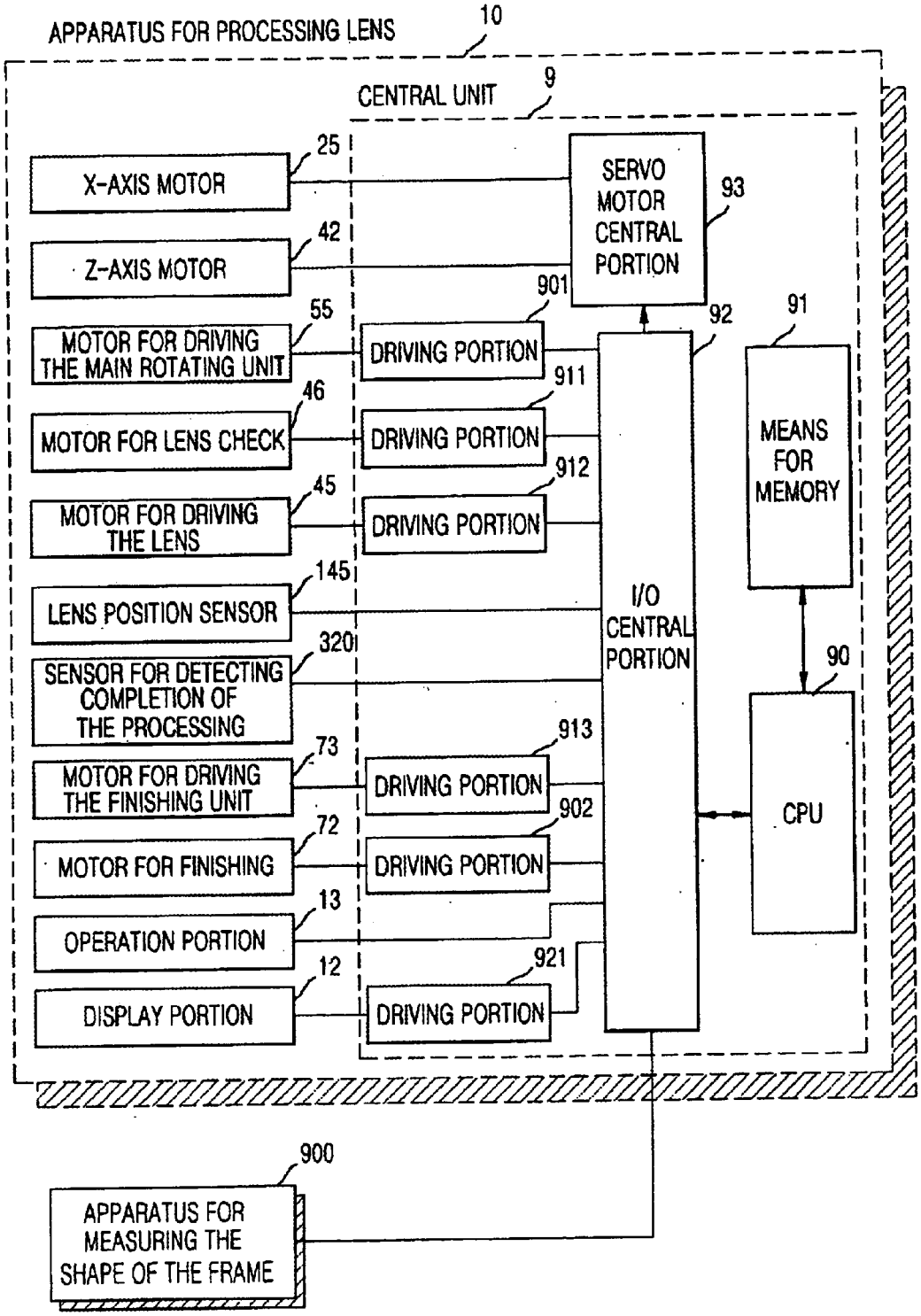
FIG. 14 is a block diagram exhibiting the control portion.
Figure 15:
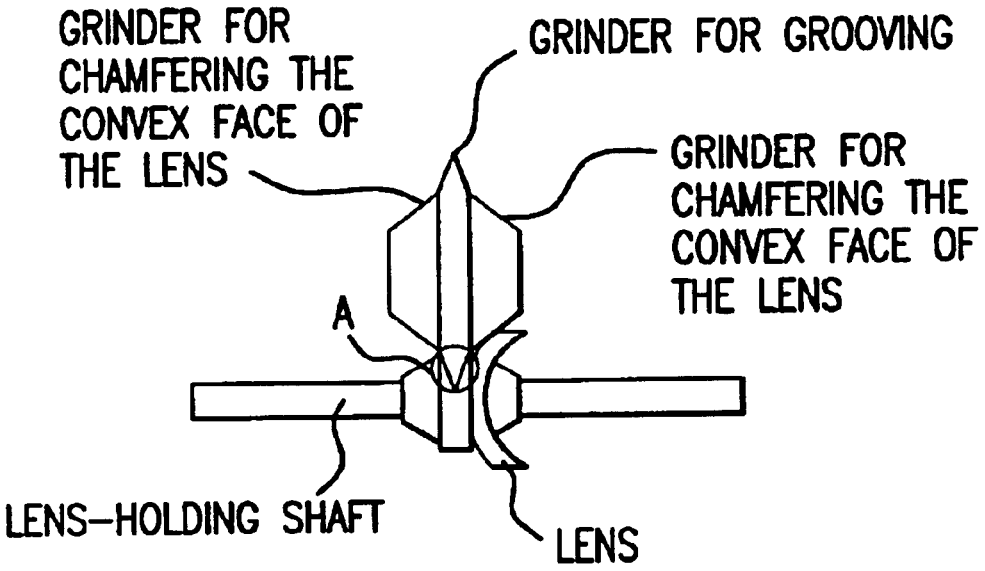
FIG.15 PRIOR ART
FIG. 15 is a side view exhibiting the relation between a lens-holding shaft and a grinder for finishing in a conventional apparatus (prior art).

When the finishing (i.e., the chamfering or the grooving) is conducted, as shown in FIG. 14, the two rotating tools 70 and 71 are displaced to positions directly above the lens-holding shaft 41 by driving the motor 73 for driving the finishing unit.

In this condition, wherein the measuring unit 6 is at the waiting position, the rotating tools 70 and 71 are advanced to positions between the styluses 60 and 61. This position, wherein the rotating tools 70 and 71 at the positions vertically above the lens-holding shaft 41, is called the "advanced position" (also referred to as the position for the processing) of the finishing unit 7.

Figure 11:
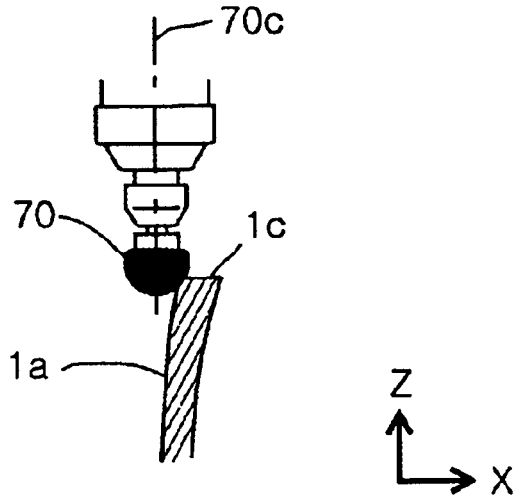
FIG. 11 is a sectional view exhibiting the chamfering of the convex face of a lens.
Figure 12:
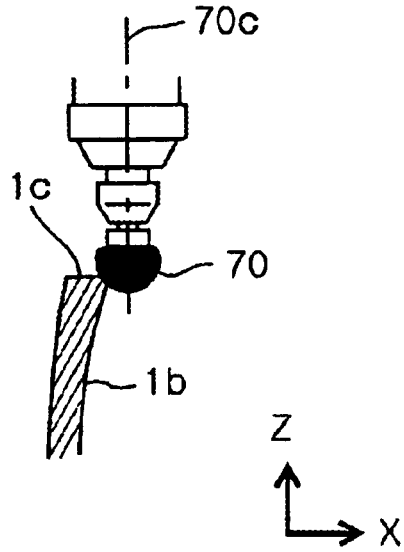
FIG. 12 is a sectional view exhibiting the chamfering of the concave face of a lens.

The finishing is conducted while the base 74 is placed at the advanced position shown in FIG. 9. For example, when grooving is performed, the base unit 2 is displaced in the direction of the X-axis in accordance with the rotation angle of the lens-holding shaft 41 and the position of the lens 1 measured by the measuring unit 6 is determined as described above so that the axial line 71*c* of the rotating tool (i.e., the end mill) 71 faces towards the prescribed position of the peripheral portion 1*c* of the lens 1. As shown in FIGS. 11, 12, 13(*a*) and 13(*b*), the lens includes convex face 1*a*, concave face 1*b*, and peripheral portion 1*c*. The peripheral portion 1*c* includes an outer peripheral portion 1*d* and an inner peripheral portion 1*e*.

Figure 10:
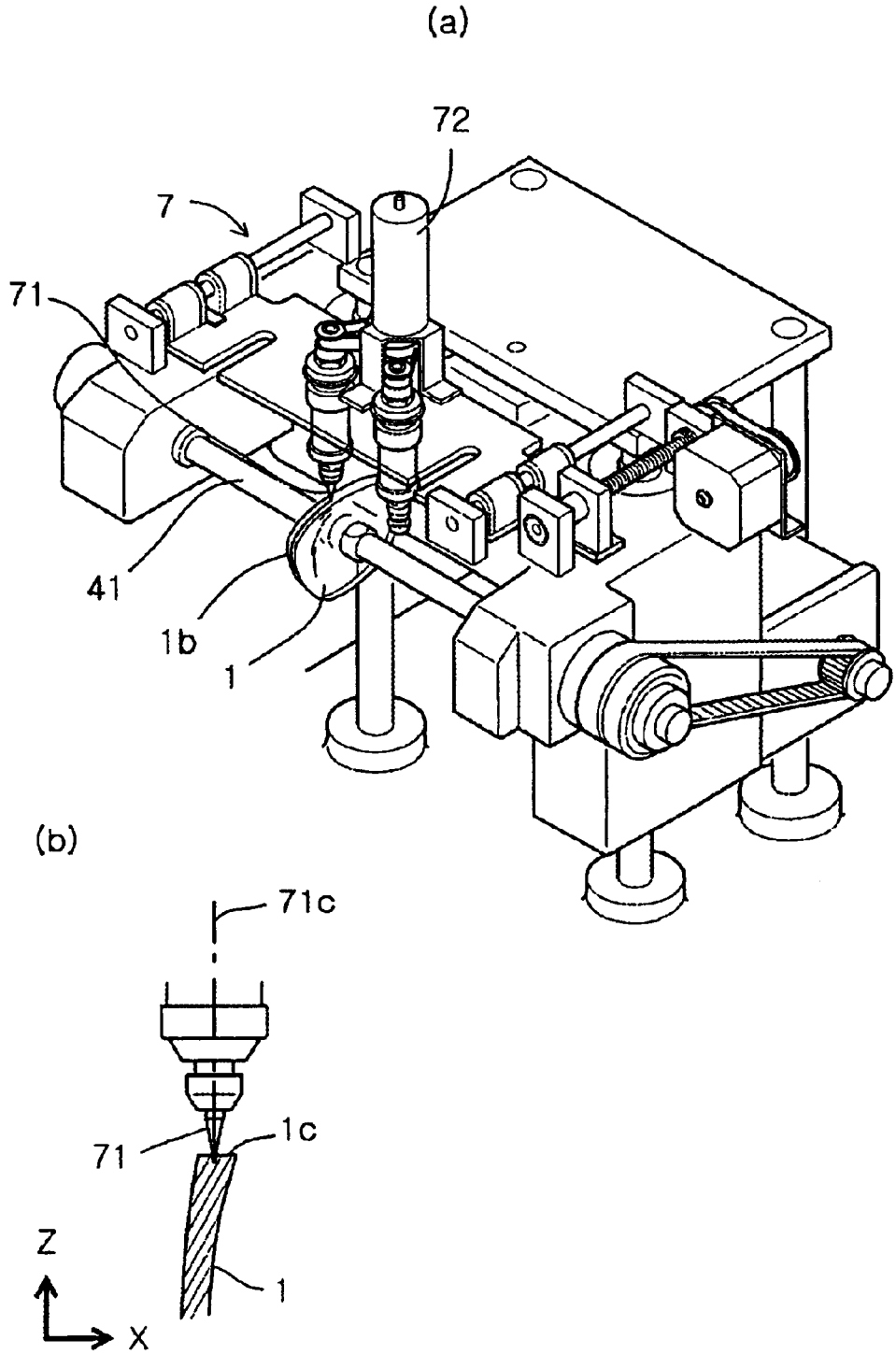
FIG. 10 shows diagrams exhibiting the grooving, in which (a) shows a perspective view of the finishing unit and (b) shows a sectional view of a lens during the grooving processing.

While the rotating tool 71 is rotated by driving the motor 72 for finishing and the lens 1 is rotated by driving the motor 45 for driving the lens, as shown in FIGS. 10(*a*) and 10(*b*), the lens unit 4 is elevated or lowered in the direction of the Z-axis in accordance with the rotation angle of the lens 1 and the base unit 2 is driven in the direction of the X-axis. A groove having the prescribed depth is formed along the peripheral portion 1*c* of the lens 1 by the rotating tool 71 that includes the end mill. Since the rotating tool 70 is connected to the motor 72 for finishing via the belt 706, the rotating tool 70 makes idle rotation without conducting any processing.

When the chamfering process follows the grooving process, and after the outer peripheral portion 1*d* of the lens 1 is displaced in the lower direction from the tip of the rotating tool 70 by the prescribed distance, the base unit 2 is driven in the direction of the X-axis and the lens unit 4 is displaced to the position where the outer peripheral portion 1*d* of the lens 1 can face towards the rotating tool 70 having the hemispherical shape.

When chamfering the convex face 1*a*, the base unit 2 is displaced in the direction of the X-axis so that the convex face 1*a* and the outer peripheral portion 1*d* are placed at a prescribed position directly below the side face of the rotating tool 70 having the hemispherical shape. As shown in FIG. 11, the lens unit 4 is elevated based on the rotation angle of the lens-holding shaft 41 and based on the position of the peripheral portion 1*c* of the lens 1 as measured by the measuring unit 6 as described above. The peripheral portion 1*c* of the lens 1 is brought into contact with the side face of the rotating tool 70 having the hemispherical shape. When chamfering of the convex face 1*a*, the axial line 70*c* of the rotating tool 70 having the hemispherical shape is, as shown in FIG. 11, placed at a position shifted to the side of the convex face 1*a* and from the outer peripheral portion 1*d* of the lens 1.

While the lens-holding shaft 41 is rotated by the motor 45 for driving the lens, the lens unit 4 is elevated or lowered and the base unit 2 is displaced in the direction of the X-axis based on the rotation angle of the lens-holding shaft 41 and based on the position of the peripheral portion 1*c* in accordance with the rotation angle, wherein the position of the peripheral portion is measured by the measuring unit 6 as described above. Thus, while lens-holding shaft 41 rotates, the lens unit 4 is elevated or lowered, and the base unit 2 is displaced along the X-axis, chamfering of the outer peripheral portion 1*d* of the convex face 1*a* of the lens 1 is conducted.

When chamfering of the inner peripheral portion 1*e* of the concave face 1*b* of the lens 1 is conducted in succession following completion of chamfering of the outer peripheral portion 1*d* of the convex face 1*a*, the peripheral portion 1*c* of the lens 1 is displaced in the lower direction from the tip of the rotating tool 71 by the prescribed distance. Then, as shown in FIG. 12, the base unit 2 is displaced in the direction of the X-axis so that the lens unit 4 is displaced to a position wherein the axial line 70*c* of the rotating tool 70 is placed at the right side of the peripheral portion 1*c* of the lens 1 as shown in FIG. 12, and the side of the rotating tool 70 having the hemispherical shape faces towards the inner peripheral portion 1*e* of the lens 1.

When chamfering the inner peripheral portion 1*e* of the lens, the lens unit 4 is elevated based on the rotation angle of the lens-holding shaft 41 and the position of the peripheral portion 1*c* of the lens 1 measured by the measuring unit 6 described above. While the lens-holding shaft is rotated by the motor 45 for driving the lens, the lens unit 4 is elevated or lowered and the base unit 2 is displaced in the direction of the X-axis based on the rotation angle of the lens-holding shaft 41 and the position of the peripheral portion 1*c* in accordance with the rotation angle, wherein the position of the peripheral portion 1*c* is measured by the measuring unit 6 described above. Thus, while lens-holding shaft 41 rotates, the lens unit 4 is elevated or lowered, and the base unit 2 is displaced along the X-axis, chamfering of the inner peripheral portion 1*e* of the concave face 1*b* of the lens 1 is conducted.

When the finishing is completed, the base 74 is driven to the waiting position, the motor 72 for finishing is stopped and the lens unit 4 is moved to the prescribed position for attachment and detachment for the lens holder 16 from the receiver 141. Thus, the processing is completed.

The Control Unit

The lens processing apparatus 10 is constructed to include the various mechanisms (units) described above, and further has a control unit 9 (also referred to as the "central unit") for controlling these various mechanisms as shown in FIG. 14.

As shown in FIG. 14, the control unit 9 includes a microprocessor (CPU) 90, a means for memory (i.e., a memory, a hard disk and the like) 91 and an I/O control portion (i.e., an interface) 92 connected to the CPU 90, which is connected to the motors and the sensors of the apparatus 10. The control unit 9 reads the data describing the shape of the lens frame that is sent from the apparatus 900 for measuring the shape of the frame. The apparatus 900 for measuring the shape of the frame is placed outside of the apparatus 10, but it is connected to send lens frame shape data to the control unit 9. The control unit 9 also reads inputted data from various sensors, and generates various output control signals to drive the various motors of the apparatus 10 so that the prescribed processing is conducted based on the properties (i.e., the material, the hardness and the like) of the lens 1, which is set by the operation portion 13. A suitable apparatus 900 for measuring the shape of the frame is the apparatus disclosed in Japanese Patent Application Laid-Open No. Heisei 6(1994)-47656; however, other similar types of devices can be used without departing from the scope of the present invention.

The control unit 9 also comprises a servomotor control portion 93 that positions the lens unit 4 in the directions of the X-axis and the Z-axis by driving the X-axis motor 25 of the base unit 2 and the Z-axis motor 42 of the elevating and lowering unit 3, respectively.

The motor 55 for driving the main rotating unit 50 and the motor 72 for finishing, which drives the rotating tools 70 and 71, are each connected to the I/O control portion 92 via driving portions 901 and 902, respectively, so that the condition of rotation, or the speed of rotation, is controlled in accordance with the direction (i.e., control signals) from the microprocessor 90.

The motor 46 for the lens chuck, which controls the holding pressure applied to the lens 1 by changing the position of the shaft 41R of the lens-holding shaft 41, is connected to the I/O control portion 92 via a driving portion 911 so as to control the holding pressure in accordance with the driving electric current.

The motor 45 for driving the lens is connected to the I/O control portion 92 via a driving portion 912 that controls the rotation angle of the lens-holding shaft 41, and therefore the rotation angle of the lens 1. The microprocessor 90 directs the processing position of the lens 1 based on the data describing the shape of the lens frame obtained from the apparatus 900 for measuring the shape of the frame. In addition to the lens frame shape data, microprocessor 90 also uses rotation angle data provided by the sensor 145 for detecting the position of the lens, which detects the rotation angle of the lens 1 to generate control signals for the Z-axis motor. Microprocessor 90 uses these control signals to drive the Z-axis motor 42 so that the processing depth, in accordance with the rotation angle based on the data describing the shape of the lens frame, is achieved.

When the prescribed processing depth is achieved, a sensor 320 for detecting completion of processing, which will be described later in detail, is switch to ON and the actual position of processing (i.e., the completed processing position) is fed back to the microprocessor 90.

The motor 73 for driving the finishing unit that drives the finishing unit 7 in the direction of the Y-axis is connected to the I/O control portion 92 via a driving portion 913, which controls the positioning.

Outputs from linear scales (not shown in the Figure) connected to the styluses 60 and 61 of the measuring unit 6 are also input into the microprocessor 90.

The operation portion 13, disposed on the front of the cover of the apparatus 10 for processing a lens, is connected to the I/O control portion 92 and transfers the direction data inputted by the operator (for example, the material of the lens 1 and whether the processing should be with or without the beveled processing or the grooving) to the microprocessor 90. Microprocessor 90 outputs the response to these operator inputted directions so that the information corresponding to the processing content is outputted to the display portion 12 via the driving portion 921.

By operating the control portion 9, data for flat grinding and data for beveled grinding that are used for flat grinding and for beveled grinding, respectively, are created by calculation from the data describing the shape of the lens frame. Furthermore, data for grooving and data for chamfering are created by calculation based on the positions of the entire peripheral portion (i.e., coordinates of apices in the section of the lens at the side of the convex face 1*a* and at the side of the concave face 1*b*) of the lens 1, wherein these positions of the entire peripheral portion are measured by the measuring unit 6 based on the data describing the shape of the lens frame.

During the processing of a lens, the servomotor control portion 93 drives the X-axis motor and the Z-axis motor in accordance with the lens processing data corresponding to the rotation angle of the lens 1, which is also the rotation angle of the lens-holding shaft 41. The rotation angle of the lens 1 is detected by the sensor 145 for detecting the position of the lens so that the lens 1 is displaced relative to the rotating tool 50 in accordance with the lens position data provided by the sensor 145. The processing is conducted in this manner.

Outline of the Processing

The lens processing procedures performed using the apparatus 10 for processing a lens will be described as follows. The outlined method includes both preparatory steps and lens processing steps.

First, the lens 1 is set into the lens-holding shaft 41. Next, the data describing the shape of the lens frame are read by the apparatus 900 for measuring the shape of the frame, which measures the shape of a lens frame that is outside of the apparatus 10. Subsequently, an operator uses the operation portion 13 to input the directions corresponding to the conditions of the lens processing, such as the material of the lens 1 and whether the processing should be with or without the beveled processing or the grooving. To begin the lens processing steps, the operator inputs the direction signal for starting the processing using the operation portion 13. Then, the steps of the lens processing are conducted.

When the start of lens processing is directed, the pressing shaft 41R of the lens-holding shaft 41 is displaced to the position for holding the lens shown in FIG. 6 by driving the motor 46 for the lens chuck and the holding pressure is set in accordance with the material of the lens 1.

To process the lens 1, the main rotating tool 50 is rotated by driving the motor 55. The lens unit 4 is lowered by driving the elevating and lowering unit 3 and the base unit 2 is displaced in the direction of the X-axis to the position where the peripheral portion 1*c* of the lens 1 is faced towards the rough grinder 50*a* for flat grinding of the main rotating tool 50. The processing depth is provided and set by the elevating and lowering unit 3 while the lens 1 is rotated by the motor 45 for driving the lens. Then, the rough grinding is conducted to achieve the processing depth calculated at every rotation angle of the lens-holding shaft 41.

When the sensor 320 for detecting completion of the processing, which is part of the above lens unit 4, gives the ON signal for the entire periphery of the lens, sensor 320 has detected that the grinding step has been completed.

Once the rough processing is completed, the lens unit 4 is temporarily elevated. The base unit 2 is moved in the direction of the X-axis to the position where the lens 1 faces towards the finishing grinder 50*b* for flat grinding of the main rotating tool 50. Then, the finishing grinding is conducted in the same manner as is conducted for the rough grinding step. When the sensor 320 for detecting completion of the processing of the lens unit 4 gives the ON signal for the entire periphery of the lens 1, the finishing processing on the entire peripheral portion of the lens 1 is completed.

When the grooving of the lens by the finishing unit 7 is necessary, the grooving is conducted by forming a groove at the peripheral portion 1*c* of the lens 1 by using the rotating tool 71 of the end mill as shown in FIG. 10. Then, the chamfering of both faces 1*a*, 1*b* of the peripheral portion of the lens 1 is conducted by successively bringing the peripheral portions 1*d* and 1*e* of the lens 1 at the side of the concave face 1*a* and the convex face 1*b*, respectively, into contact with the side of the rotating tool 70 having the hemispherical shape by driving the base unit 2 in the direction of the X-axis.

Once grooving and chamfering steps are completed, the pressing shaft 41R of the lens-holding shaft 41 is displaced to the position for releasing the lens shown in FIG. 7 by driving the motor 46 for the lens chuck. With the apparatus 10 in the lens releasing condition, the operator removes the completely processed lens 1 from the apparatus.

Workings of the Apparatus in Accordance with the Present Invention

As described above, because the rotating tool 70 having the hemispherical shape for chamfering and the rotating tool 71 constructed to include the end mill for grooving are independently formed (i.e., are separate structures), and because each of these tools are disposed at positions separated by the prescribed distance along the lens-holding shaft 41, the rotating tool 71 for grooving does not interfere with the lens-holding shaft 41 or the receiver 141 of the lens holder during the chamfering step even when the lens 1 has a small diameter. Therefore, chamfering and grooving can be conducted accurately for a lens 1 having any size.

Because the rotating tool 70 for chamfering and the rotating tool 71 for grooving used in the finishing steps are fixed at the base 74 that is displaceable in the direction of the Y-axis, and because the positioning of the lens is conducted by the lens unit 4 that is displaceable in the vertical direction and in the direction of the main shaft 51, it is not necessary that lens positioning be controlled by the finishing unit. It is merely necessary that the finishing unit be accurately positioned between the advanced position shown in FIG. 9 and the retired position shown in FIG. 8. Therefore, the mechanism of the finishing unit can be simplified, thereby decreasing the cost of production. In addition, because the two rotating tools 70 and 71 are driven efficiently by a single motor 72, there is no need to provide a second motor to drive both tools. Thus, there is no need to increase the size of the apparatus which keeps the costs of production down.

Because the lens unit 4 is displaceable relative to the fixed rotating tools 70 and 71, and because the lens unit 4 can be positioned in the same manner for flat grinding or for beveled grinding in which the lens 1 is displaced relative to the main rotating tool 50, the main processing and the finishing processing, such as the chamfering and the grooving of the peripheral portion of the lens, can be conducted by a single positioning mechanism under a single control unit that directs positioning. Therefore, the complexity of the positioning mechanism and the control of the positioning mechanism can be minimized so as to keep the cost of production down.

The rotating tool 70 having the hemispherical shape is formed with a grinder or a cutter having diamond or the like and has the prescribed radius R as shown in FIG. 13(*a*). As shown in FIG. 13(*b*), when the lens 1, or the lens-holding shaft 41, is elevated from the lower position in the Figure, the angle of chamfering θ at the portion to be chamfered (in this case, the inner peripheral portion 1*e*) is decided in accordance with the processing depth Lx in the direction of the X-axis (i.e., the displacement in the direction of the axis of rotation of the lens 1) and the processing depth Lr in the direction of the Z-axis (i.e., the displacement in the radial direction of the lens 1).

The processing depth Lx is the distance in the direction of the X-axis from an apex C to an apex D. The apex C is the intersection of the line of the peripheral face 1*c* and the line of the concave face 1*b* in the section of the lens 1 before the processing at one rotation angle. The apex D is the intersection of the line of the outer peripheral face 1*d* and the line S chamfered from face 1*e* in the section of the lens 1 after the processing at the same rotation angle. The processing depth Lz is the distance in the direction of the Z-axis (i.e., in the radial direction of the lens) from the apex C to an apex E. The apex E is the intersection of the line of the concave face 1*b* and the line S chamfered from face 1*e* in the section of the lens 1 after the processing. The angle θ between the outer peripheral face 1*d* and the chamfered portion of face 1*e* can be set as desired in accordance with the ratio of Lx to Lz. The X- and Y-coordinates of the apex C change depending on the rotation angle of lens 1 (which is also the rotation angle of the lens-holding shaft 41). These coordinates are values obtained by the measurement performed in advance using the styluses 60 and 61 of the measuring unit 6 as described above to measure the side of the convex face 1*a* and the side of the concave face 1*b*.

The chamfered portion of face 1*e* has a concave shape as shown in FIG. 13 because the rotating tool 70 having the hemispherical shape having the radium R is used. The angle between the straight line S passing through the apices D and E after processing and the outer peripheral face 1*d* is used to define the chamfering angle θ.

Therefore, for the control of positioning in accordance with the chamfering angle θ of the lens 1, as shown in FIG. 13(*b*), the ratio of the processing depths Lx to Lz is obtained when the chamfering angle θ is decided. Then, when either one of the two processing depths in the direction of the X-axis or in the direction of the Z-axis (i.e., in the radial direction) is decided, both of the distances Lx and Lz from the apex C can be determined before processing to the apices D and E, respectively. When circles having a radius R, which is the same as the radius R of the hemispherical shape of the rotating tool, are drawn at the centers placed at these apices D and E, the intersection of these circles gives the X- and Z-coordinates of the center of the sphere 70*cr* of the tool as shown in FIG. 13(*b*).

Figure 13A:
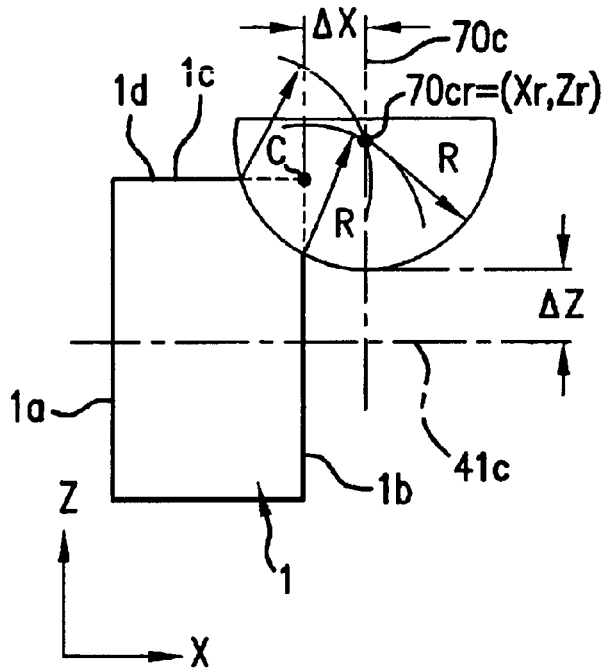
FIG. 13 is a diagram describing the relative positions of the lens and the rotating tool having a hemispherical shape, in which (a) shows the coordinates of the tool and the position of the lens and (b) shows the relation between the apices of the lens and the chamfered portion of face portion 1*e*.
Figure 13B:
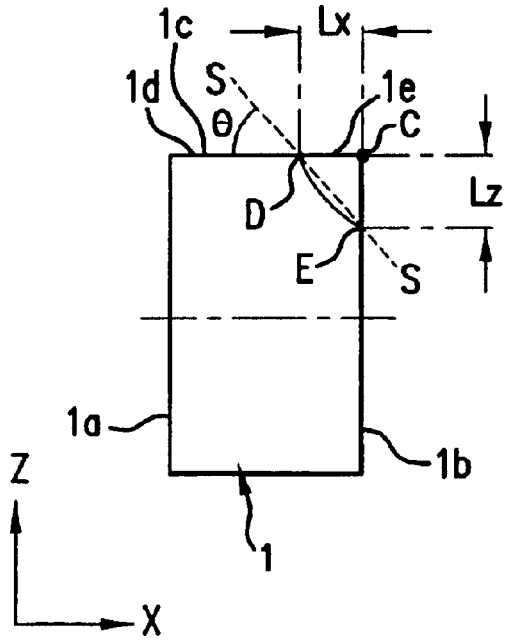

When the chamfering angle θ and the chamfering amount (i.e., the processing depth) are set as described above, the relative positions of the lens 1 and the rotating tool 70 having the hemispherical shape in accordance with the desired chamfering angle θ, and the desired processing depth (i.e., the position of the axial line of the lens-holding shaft 41*c* in the direction of the Z-axis (Δz) and the position of the apex C in the direction of the X-axis (Δx) in FIG. 13(A)) can be determined by calculating the coordinates (Xr, Zr) of the center of the sphere 70*cr* of the rotating tool 70 having the hemispherical shape from the coordinates of the apex C measured before processing at every rotation angle. When the rotating tool 70 for chamfering is kept rotating at the prescribed position (i.e., on the vertical line of the lens-holding shaft 41), and the lens unit 4 is elevated and lowered and, simultaneously, displaced in the direction of the X-axis by the displacement of the base unit 2 while the lens 1 is also rotated, the chamfering at the convex side and at the concave side of the lens 1 can be achieved to the desired chamfering angle θ. This allows the finishing unit 7 to chamfer to the desired chamfering depth using a simplified mechanism for the rotating tool. Moreover, since chamfering can be conducted in various manners using a single rotating tool having the hemispherical shape 70, exchange of tools is not necessary and the processing time is decreased.

As shown in FIG. 13, chamfering is conducted at the side of the concave face 1*b* at the inner peripheral portion 1*e* of the lens 1. For chamfering at the side of the convex face 1*a*, the relative distance Δz between the lens-holding shaft 41 and the rotating tool 70 in the direction of the Z-axis and the relative distance Δx between the coordinate of the apex of the lens 1 and the center 70*cr* of the rotating tool 70 are determined from the coordinates of the apices, the chamfering angle θ and the chamfering depth at every rotation angle based on the data corresponding to the position of the peripheral portion 1*c* of the lens, which are set in advance.

Since the radius R of the rotating tool 70 having the hemispherical shape is constructed independently of the rotating tool 71 for grooving, the width of the formed groove is not restricted, which is unlike in the conventional case wherein chamfering and grooving are conducted by using a single ball end mill. Therefore, the radius R can be set at the most suitable value for chamfering without worry about interference.

In the above embodiment, the present invention is applied to the apparatus 10 in which the processing of the lens 1 is conducted by displacing the lens-holding shaft 41 in the vertical direction. The present invention can also be applied to an apparatus having an arm which supports a lens-holding arm in a manner such that the lens-holding arm can be swung in a conventional manner. For example, when an arm and a positioning member for deciding the angle of the arm can be set in a manner such that the arm and the positioning member can be brought into contact with, or separated from, each other, the relative displacement between the arm and the positioning member is detected after being amplified by a sensor arm. In this case, the position of the contact between the arm and the positioning member is detected based on the relative displacement amplified by the sensor arm, so the same effect as that described for the above embodiment can be obtained. The present invention can be applied in the same manner to apparatuses in which a lens-holding shaft is displaced in the horizontal direction as well.

While the present invention has been described with reference to certain illustrative embodiments, one of ordinary skill in the art will recognize that additions, deletions, substitutions, modifications and improvements can be made while remaining within the spirit and scope of the present invention as defined by the appended claims.

What is claimed is:

1. An apparatus for processing a lens, comprising:

(a) a finishing unit constructed to chamfer and groove a peripheral portion of a spectacle lens;

(b) a holding shaft arranged to support the lens;

(c) a lens-holding unit connected to rotate the holding shaft and displace the lens towards the finishing unit based on data describing a shape of a lens frame and a rotation angle of the holding shaft; and (d) a positioning device connected to displace the lens in an axial direction of the holding shaft;

wherein the finishing unit further comprises:

i. a rotating tool for chamfering and a rotating tool for grooving, both tools being disposed at positions separated by a prescribed distance along the holding shaft; and ii. a drive connected to drive the rotating tool for chamfering and the rotating tool for grooving, wherein one of the rotating tool for chamfering and the rotating tool for grooving is selected for finish processing in accordance with a displacement in the axial direction of the positioning device to a prescribed position for processing, or to a prescribed processing depth set in accordance with displacement in the axial direction, wherein the finishing unit is displaceable between a first position for processing where the rotating tool for chamfering and the rotating tool for grooving face towards the holding shaft and a prescribed waiting position that is separated from the first position where the rotating tool for chamfering and the rotating tool for grooving face towards the holding shaft.

2. An apparatus according to claim 1, wherein the lens-holding unit is freely displaceable in a vertical direction orthogonal to the axial direction and defined by a height of the apparatus, the finishing unit is disposed at a position vertically above the holding shaft, and positioning device is connected to position the lens relative to the rotating tool for chamfering and the rotating tool for grooving based on the first position in the axial direction determined in accordance with a rotating angle measured in advance based on data describing a shape of a lens frame.

3. An apparatus according to claim 2, wherein, at the prescribed waiting position, a first distance from the holding shaft to the rotating tool for grooving is set to be longer than a second distance from the holding shaft to the rotating tool for chamfering.

4. An apparatus according to claim 3, wherein the rotating tool for chamfering and the rotating tool for grooving are each disposed on a respective shaft standing in a direction perpendicular to the holding shaft.

5. An apparatus according to claim 1, wherein the rotating tool for chamfering includes a rotating tool having a hemispherical shape.

6. An apparatus according to claim 1, wherein the drive includes a single motor, and the rotating tool for chamfering and the rotating tool for grooving are simultaneously driven by the single motor, and a transmission is provided connected to the single motor so that the single motor drives both the rotating tool for chamfering and the rotating tool for grooving.

7. An apparatus for processing a lens, comprising:

a rotating tool constructed to chamfer a peripheral portion of a spectacle lens;

a holding shaft disposed to support the lens;

a lens-holding unit disposed to rotate the holding shaft and displace the lens towards the finishing unit based on data describing a shape of a lens frame and a rotation angle of the holding shaft;

a positioning device connected to displaces the lens in an axial direction of the holding shaft;

wherein the rotating tool for chamfering includes a drive connected to drive a rotating tool having a hemispherical shape, wherein a chamfering angle, or a chamfering amount, is set in accordance with a displacement in the axial direction of positioning device in an axial direction and a displacement of the lens-holding unit, and wherein the rotating tool for chamfering is displaceable between a first position for processing where the rotating tool for chamfering face towards the holding shaft and a prescribed waiting position that is separated from the first position where the rotating tool for chamfering faces toward the holding shaft.

8. An apparatus according to claim 7, wherein the rotating tool for chamfering is disposed in a direction perpendicular to the holding shaft and is fixed at the prescribed position during lens processing.

* * * * *